US011692705B2

(12) United States Patent
Kiyama et al.

(10) Patent No.: US 11,692,705 B2
(45) Date of Patent: Jul. 4, 2023

(54) SOLID FUEL BURNER, BOILER EQUIPMENT, NOZZLE UNIT FOR SOLID FUEL BURNER, AND GUIDE VANE UNIT

(71) Applicant: MITSUBISHI POWER, LTD., Yokohama (JP)

(72) Inventors: Kenji Kiyama, Yokohama (JP); Kenichi Ochi, Yokohama (JP); Shohei Mito, Yokohama (JP); Kosuke Kitakaze, Yokohama (JP); Toshihiko Mine, Yokohama (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 38 days.

(21) Appl. No.: 16/973,891

(22) PCT Filed: Apr. 23, 2020

(86) PCT No.: PCT/JP2020/017527
§ 371 (c)(1),
(2) Date: Dec. 10, 2020

(87) PCT Pub. No.: WO2020/230578
PCT Pub. Date: Nov. 19, 2020

(65) Prior Publication Data

US 2021/0247064 A1 Aug. 12, 2021

(30) Foreign Application Priority Data

May 13, 2019 (WO) ..... PCT/JP2019/018982
May 20, 2019 (WO) ..... PCT/JP2019/019911

(51) Int. Cl.
*F23D 1/00* (2006.01)

(52) U.S. Cl.
CPC ..... *F23D 1/00* (2013.01); *F23D 2201/10* (2013.01); *F23D 2201/20* (2013.01)

(58) Field of Classification Search
None
See application file for complete search history.

(56) References Cited

U.S. PATENT DOCUMENTS 3,399,950 A * 9/1968 Martin ..... F23D 17/00 431/153
2006/0030649 A1* 2/2006 Takeko ..... C08K 5/5477 524/188
2007/0026356 A1 2/2007 Okazaki et al.

FOREIGN PATENT DOCUMENTS

JP 2000356309 A * 12/2000
JP 2002048306 A * 2/2002
(Continued)

OTHER PUBLICATIONS

English translation of JP 2006189188.*
(Continued)

*Primary Examiner* — Jason Lau
(74) *Attorney, Agent, or Firm* — WHDA, LLP

(57) ABSTRACT

A solid fuel burner to be inserted into a burner throat bored in a wall portion of a furnace, comprising: a solid fuel nozzle for ejecting mixed fluid of solid fuel and primary air; a secondary air nozzle for ejecting secondary air; a tertiary air nozzle for ejecting tertiary air; a secondary air guide member for guiding a flow of the secondary air outwardly in a radial direction; and one or more tertiary air guide members for guiding a flow of the tertiary air outwardly in the radial direction at a first angle with respect to a central axis (C) of the solid fuel burner, wherein a distal end position (X2) of each of the tertiary air guide members in an axial direction of the solid fuel burner is at a closer side of the furnace than a distal end position (X1) of the secondary air guide member.

16 Claims, 21 Drawing Sheets

(56) References Cited

FOREIGN PATENT DOCUMENTS

| | | | | | |
|---|---|---|---|---|---|
| JP | 2006189188 | A | * | 7/2006 | ..... F23C 6/045 |
| JP | 3986182 | B2 | | 10/2007 | |
| KR | 20060030649 | A | * | 4/2006 | |
| TW | 201812214 | A | | 4/2018 | |

OTHER PUBLICATIONS

English translation of JP 200248306.*
International Search Report dated Jun. 23, 2020, issued in counterpart International Application No. PCT/JP2020/017527 (2 pages).
The Office Action dated Nov. 2, 2022, issued in counterpart CN application No. 202080004303.4, with Machine Translation.

* cited by examiner

<PRIOR ART>

SOLID FUEL BURNER, BOILER EQUIPMENT, NOZZLE UNIT FOR SOLID FUEL BURNER, AND GUIDE VANE UNIT

TECHNICAL FIELD

The present invention relates to a solid fuel burner for burning solid fuel such as pulverized coal or biomass, boiler equipment provided with the solid fuel burner, a nozzle unit of the solid fuel burner, and a guide vane unit attached to the solid fuel burner.

BACKGROUND ART

As background art in the technical filed to which the present invention belongs, Patent Literature 1 discloses "a pulverized coal combustion burner comprising: a pulverized coal nozzle for ejecting mixture of pulverized coal and primary air; a secondary air nozzle for ejecting secondary air, which is provided concentrically with the pulverized coal nozzle on an outside of the pulverized coal nozzle; a tertiary air nozzle for ejecting tertiary air, which is provided concentrically with the secondary air nozzle on an outside of the secondary air nozzle; and an expanded pipe portion which is provided on a distal end portion of a partition wall dividing a secondary air flow path and a tertiary air flow path, wherein an obstacle including a plane substantially vertical to a flow of the primary air and a guide plate including a plane substantially vertical to a flow of the secondary air are provided on a distal end of a partition wall dividing the pulverized coal nozzle and the secondary air nozzle, the plane of the obstacle is positioned on the upstream side of the pulverized coal nozzle in the axial direction thereof from the plane of the guide plate, and the plane of the guide plate is provided to project from a distal end of the expanded pipe portion toward the downstream side of the pulverized coal nozzle in the axial direction thereof".

According to Patent Literature 1, since the guide plate deflects the flow of the secondary air outwardly in the radial direction, it is possible to enlarge a reducing flame region with low oxygen concentration which is formed by the primary air. As a result, generation of NOx can be suppressed.

CITATION LIST

Patent Literature

Patent Literature 1: JP-3-3986182

SUMMARY OF INVENTION

Technical Problem

However, when enlarging the reducing flame region with low oxygen concentration, mixing of the solid fuel with the secondary air and the tertiary air is slowed down, which tends to increase unburned combustibles and CO. Accordingly, it is necessary to modify the solid fuel burner disclosed in Patent Literature 1 in order to further reduce unburned combustibles and CO.

An object of the present invention is to provide a solid fuel burner, boiler equipment, a nozzle unit of the solid fuel burner, and a guide vane unit which can reduce unburned combustibles and CO while suppressing generation of NOx.

Solution to Problem

In order to achieve the objective described above, the present invention provides, as a representative aspect, a solid fuel burner to be inserted into a burner throat bored in a wall portion of a furnace, the solid fuel burner comprising: a solid fuel nozzle for ejecting mixed fluid of solid fuel and primary air; a secondary air nozzle for ejecting secondary air, which is provided concentrically with the solid fuel nozzle on an outside of the solid fuel nozzle; a tertiary air nozzle for ejecting tertiary air, which is provided concentrically with the secondary air nozzle on an outside of the secondary air nozzle; a secondary air guide member for guiding a flow of the secondary air outwardly in a radial direction, which is positioned on an outer peripheral portion at a distal end of the solid fuel nozzle; and one or more tertiary air guide members for guiding a flow of the tertiary air outwardly in the radial direction at a first angle with respect to a central axis of the solid fuel burner, which are provided on a distal end of the tertiary air nozzle, wherein a distal end position of each of the tertiary air guide members in an axial direction of the solid fuel burner is at a closer side of the furnace than a distal end position of the secondary air guide member, the burner throat is formed such that an inner peripheral surface thereof inclines at a second angle with respect to the central axis to expand a diameter from a burner side of the wall portion of the furnace toward a furnace side, the first angle is set in a range of 10 degrees to 40 degrees with respect to the central axis, the second angle is greater than the first angle, a seal air introduction member for introducing a part of the tertiary air as seal air is provided between the tertiary air guide member and the burner throat, the seal air introduction member is inclined outwardly in the radial direction at a third angle with respect to the central axis, and a seal air deflection member for deflecting the seal air outwardly in the radial direction is provided on a distal end portion of the seal air introduction member.

ADVANTAGEOUS EFFECTS OF INVENTION

According to the present invention, it is possible to reduce unburned combustibles and CO while suppressing NOx. The problems, configurations, and effects other than those described above will be clarified by explanation of the embodiments below.

DESCRIPTION OF EMBODIMENTS

Figure 1:
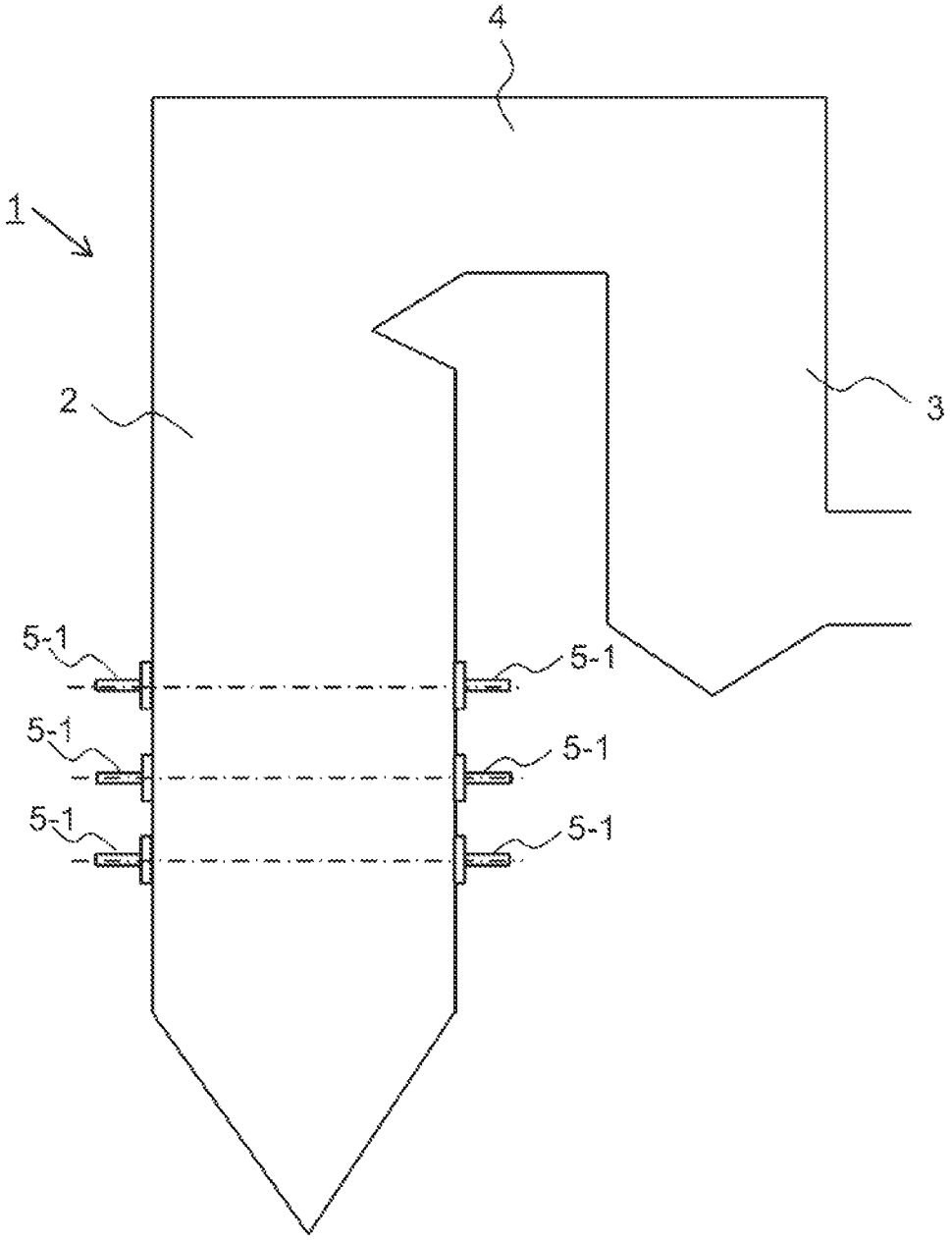
FIG. 1 is a side view illustrating an overall structure of boiler equipment according to embodiments of the present invention.

Hereinafter, embodiments of the present invention will be described with reference to the drawings. FIG. 1 is a side view illustrating an overall structure of boiler equipment according to an embodiment of the present invention. Boiler equipment 1 according to the present embodiment includes a furnace 2, a cage portion (rear heat transfer portion) 3, and an auxiliary side wall 4 connecting the furnace 2 and the cage portion 3. On the furnace 2, a plurality of solid fuel burners 5-1 according to a first embodiment which will be described later is provided, and each of the plurality of solid fuel burners 5-1 is arranged to face each other in multiple stages. Solid fuel ejected from each solid fuel burner 5-1 is burned in the furnace 2 and flown through the auxiliary side wall 4 and the cage portion 3 in this order as combustion exhaust gas, and thereafter, discharged to the atmosphere through exhaust gas treatment equipment (not illustrated). Other solid fuel burners according to other embodiments which will be described in this specification can be also applied to the boiler equipment 1 illustrated in FIG. 1. The boiler equipment 1 illustrated in FIG. 1 employs single-stage combustion without including an opening (after-air port) for supplying only air to an upper portion of the solid fuel burners 5-1 in the furnace 2. Meanwhile, it may employ two-stage combustion and include an after-air port.

First Embodiment

Figure 2:
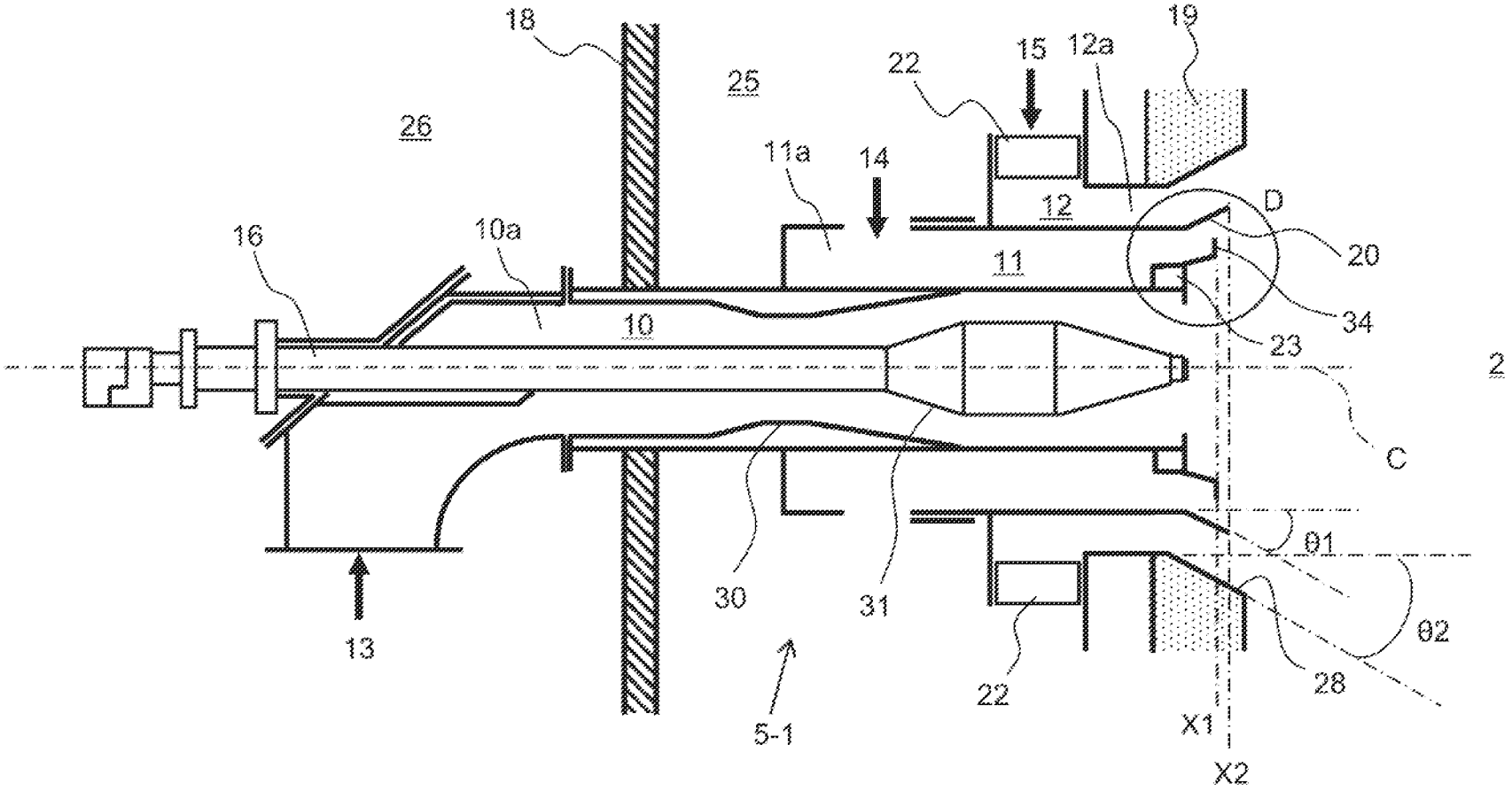
FIG. 2 is a schematic view of a solid fuel burner according to a first embodiment.
Figure 3:
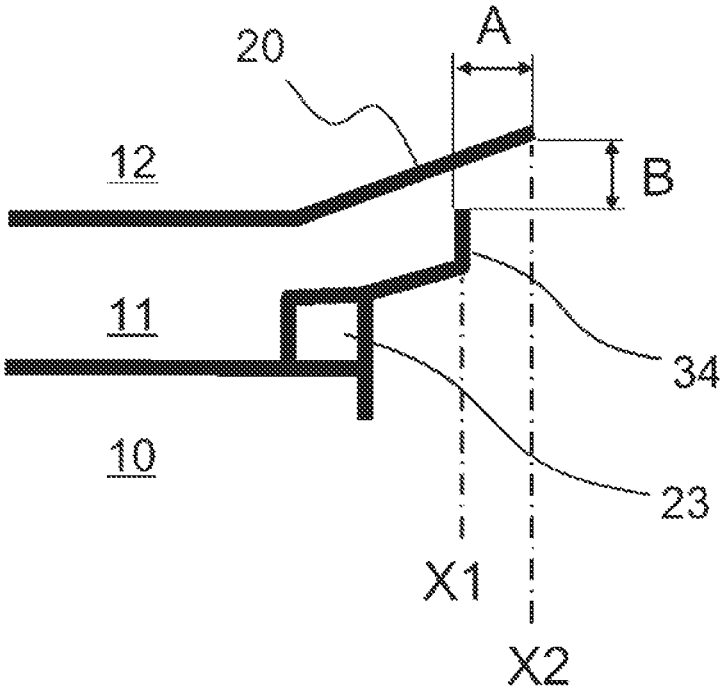
FIG. 3 is an enlarged view of a D portion illustrated in FIG. 2.

Next, the solid fuel burner 5-1 according to the first embodiment of the present invention will be described. FIG. 2 is a schematic view of the solid fuel burner 5-1 according to the first embodiment. FIG. 3 is an enlarged view of a D portion illustrated in FIG. 2. As illustrated in FIG. 2, the solid fuel burner 5-1 is attached to a water wall 19 of the furnace 2 such that a nozzle tip (burner outlet side) thereof is inserted horizontally with respect to a burner throat 28 bored in the water wall 19 which is a wall of the furnace 2. The burner throat 28 is an opening which is formed by spreading the diameter thereof from the burner 5-1 side of the water wall 19 (outside of the water wall 19) toward the furnace 2 side (inside of the water wall 19) such that an inner peripheral surface is inclined at a second angle θ2 with respect to a burner central axis C.

The solid fuel burner 5-1 includes a fuel nozzle (solid fuel nozzle) 10. The fuel nozzle 10 is a cylindrical member of which the base side is connected to a fuel-containing fluid pipe (not illustrated). The fuel nozzle 10 is provided at the inside thereof with a primary air flow path 10*a* through which a solid-gas two-phase flow (mixed fluid 13) of solid fuel and primary air (carrier gas) flows. The solid fuel may be solid or powder such as coal (pulverized coal) or biomass, or a mixture thereof. In the present embodiment, an example using pulverized coal as the solid fuel is explained. In this connection, hereinafter, the mixed fluid 13 may be referred to as primary air 13.

On the outside (outer peripheral side) of the fuel nozzle 10, a secondary air nozzle 11 including a secondary air flow path 11*a* through which secondary air 14 flows is provided, and on the outside (outer peripheral side) of the secondary air nozzle 11, a tertiary air nozzle 12 including a tertiary air flow path 12*a* through which tertiary air 15 flows is provided. The secondary air 14 and the tertiary air 15 are gas that support combustion, and air is usually used therefor in the same manner as the primary air which is the carrier gas. Meanwhile, for example, combustion exhaust gas, oxygen-rich gas, or mixed gas of two or more of the above-mentioned gas with air can also be used therefor.

Viewing the fuel nozzle 10, the secondary air nozzle 11, and the tertiary air nozzle 12 from the front of the burner outlet side (furnace 2 side), the annular secondary air nozzle 11 is concentrically disposed on the outside of the fuel nozzle 10, and the annular tertiary air nozzle 12 is concentrically disposed on the outside of the secondary air nozzle 11, both with the fuel nozzle 10 as the center. In the first embodiment, a swirl generator 22 for giving swirl to the tertiary air 15 is disposed on an inlet portion of the tertiary air flow path 12*a*, meanwhile, it may not be provided thereon.

The fuel nozzle 10 is provided at the inside thereof with a start-up burner (oil gun) 16 penetrating the fuel nozzle 10, which is used for preheating or assisting combustion at the time of starting the boiler or low load operation of the boiler. Meanwhile, depending on the structure of the solid fuel burner 5-1, the start-up burner 16 may not be disposed.

An open end of the fuel nozzle 10 (i.e., outlet on the furnace 2 side) is provided with a flame stabilizer 23 for forming a circulating flow 51 (see FIG. 4A) between respective outlets of the primary air 13 and the secondary air 14. The flame stabilizer 23 is disposed on an outer periphery at a distal end of the fuel nozzle 10 to form the circulating flow 51 on the downstream side of the flame stabilizer 23 so as to increase ignitability and flame holding effect.

Each of the start-up burner 16, the fuel nozzle 10, the secondary air nozzle 11, and the tertiary air nozzle 12 ejects an object to be ejected toward the furnace 2. The start-up burner 16, the fuel nozzle 10, the secondary air nozzle 11, and the tertiary air nozzle 12 are disposed in a wind box 25 surrounding the burner throat 28. The combustion air is supplied through the window box 25. A partition wall 18 is a wall-like member separating the inner space of the window box 25 and the outside 26 of the furnace.

A distal end portion of a partition wall separating the secondary air flow path 11*a* and the tertiary air flow path 12*a* is provided with a guide sleeve 20 (in the shape spreading toward the end) which spreads in the radial direction with respect to a burner central axis C. The guide sleeve (tertiary air guide member) 20 is inclined at a first angle θ1 outwardly in the radial direction with respect to the burner central axis C. The first angle θ1 is substantially the same as a second angle θ2 which is the inclination angle of an inner peripheral surface of the burner throat 28 described above, and is set within a range of 10 degrees to 40 degrees. More preferably, the first angle θ1 and the second angle θ2 are set within a range of 20 degrees to 30 degrees.

When the first angle θ1 and the second angle θ2 are more than 40 degrees, the secondary air 14 and the tertiary air 15 flow too much toward the outside in the radial direction, which makes a reducing flame region by the primary air 13 too large. As a result, the effect of reducing unburned combustibles, which is residues of the solid fuel, and the effect of reducing CO cannot be expected much. When the first angle θ1 and the second angle θ2 are less than 10 degrees, the reducing flame region becomes small, and as a result, the effect of reducing NOx cannot be expected much. For the reasons above, the first angle θ1 and the second angle θ2 are preferably set within the range of 10 degrees to 40 degrees, and when setting them within the range of 20 degrees to 30 degrees, the effect of reducing unburned combustibles of the solid fuel and CO as well as the effect of reducing NOx can be balanced, which is more preferable. In this connection, the guide sleeve 20 may be disposed anywhere as long as it is positioned at a distal end portion of the tertiary air nozzle 12 on the outer peripheral side of the secondary air nozzle 11. For example, the guide sleeve 20 may be fixed to a distal end of the outlet of the secondary air nozzle 11 on the outer periphery thereof, or may be fixed directly or indirectly to the burner throat 28 in a state where the guide sleeve 20 is positioned at the distal end of the outlet of the secondary air nozzle 11 on the outer periphery thereof.

On an outer peripheral portion at a distal end of the flame stabilizer 23, a ring-shaped guide ring (secondary air guide member) 34 extending outwardly in a radial direction is disposed. The guide ring 34 includes a substantially vertical plane which is substantially perpendicular to the burner central axis C.

Here, the positional relationship between the guide sleeve 20 and the guide ring 34 will be described in detail. As illustrated in FIG. 3, the guide sleeve 20 overlaps with the guide ring 34 in the direction along the burner central axis C (axial direction), and a distal end position X2 of the guide sleeve 20 is at a closer side of the furnace 2 (right side of FIG. 3) than a distal end position X1 of the guide ring 34. In other words, the distal end position X2 is on the downstream side of air flow further than the distal end position X1. Furthermore, when a distance between a front side surface of the guide ring 34 (side surface opposite to a side surface of the guide ring 34 facing the furnace 2) and a distal end of the inner peripheral surface of the guide sleeve 20, that is, the length in which the guide sleeve 20 overlaps with the guide ring 34 is referred to A, and when a distance between the distal end of the inner peripheral surface of the guide sleeve 20 and an outer peripheral end of the guide ring 34, that is, the gap between the guide sleeve 20 and the guide ring 34 in their height direction is referred to B, the relationship between the length A and the gap B is set to satisfy A>0.5×B. The distal end position X2 of the guide sleeve 20 and the distal end position X1 of the guide ring 34 are accommodated in the burner throat 28, and thus do not project from the inner peripheral surface of the water wall 19 toward the inner side of the furnace 2.

Figure 4A:
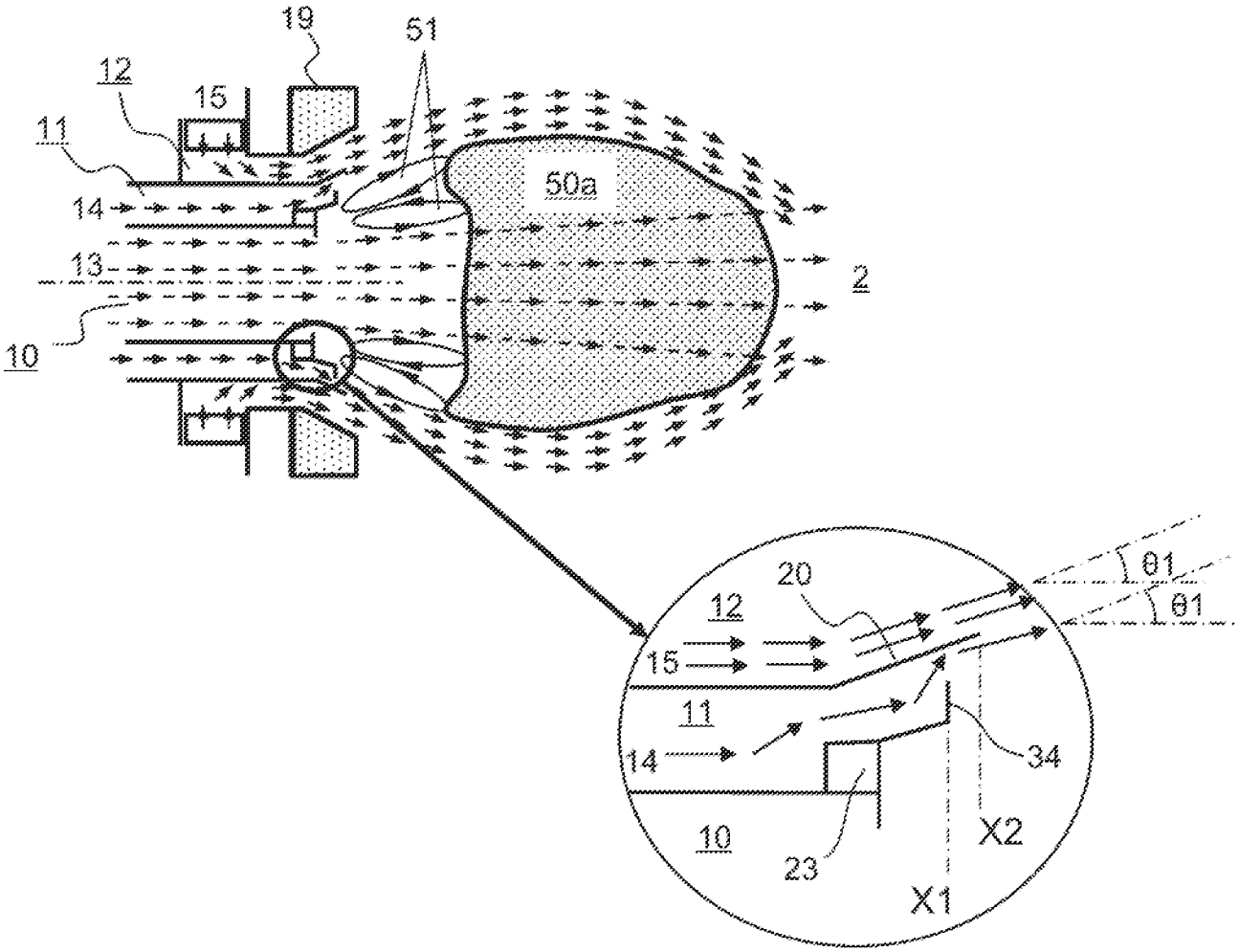
FIG. 4A illustrates a flow of air in a nozzle tip region of a solid fuel burner according to the first embodiment of the present invention.
Figure 4B:
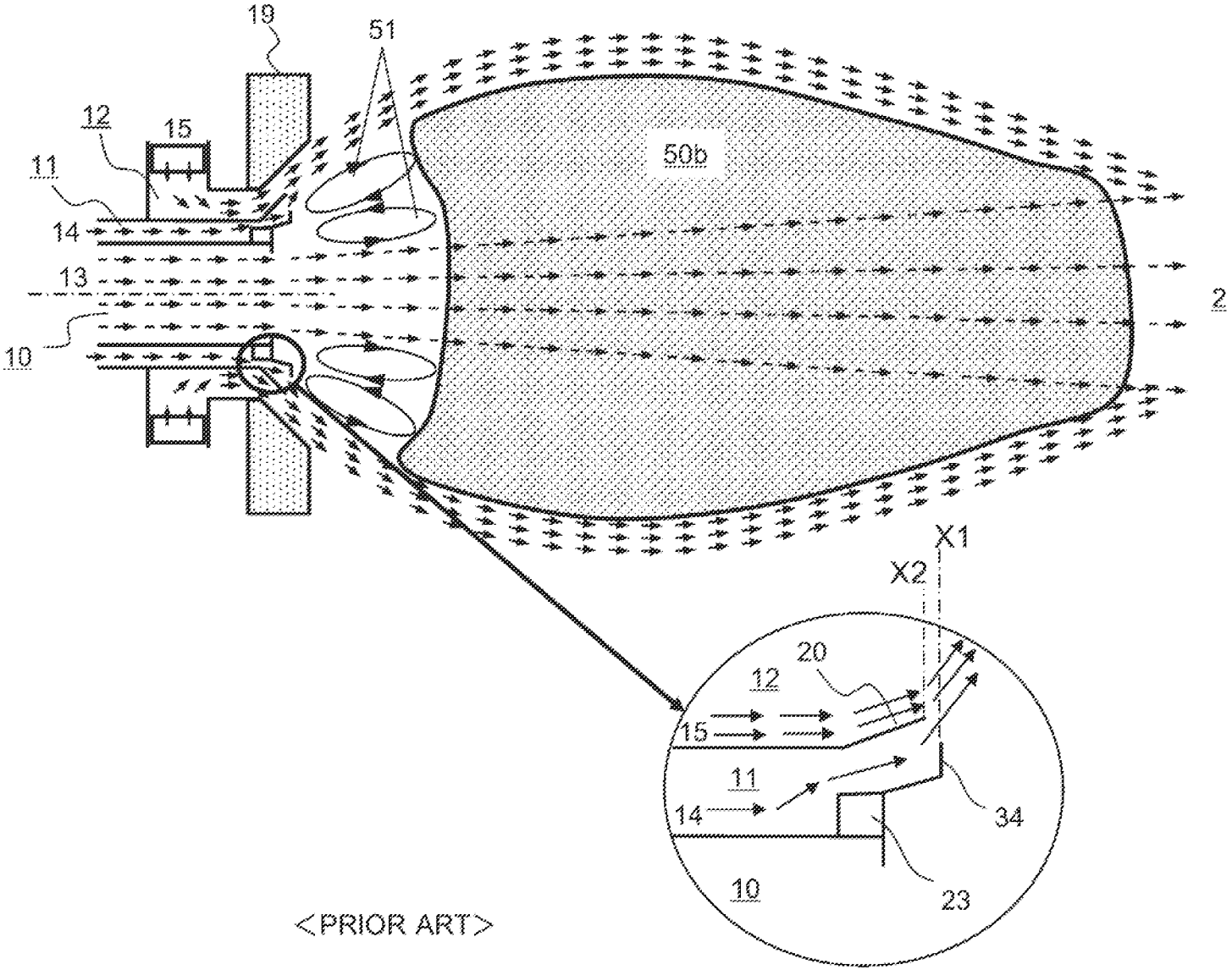
FIG. 4B illustrates a flow of air in a nozzle tip region of a conventional solid fuel burner.

Next, a flow of air in a nozzle tip region of the solid fuel burner 5-1 according to the first embodiment will be described while comparing it with the prior art. First, with reference to FIG. 4B, the flow of air in the nozzle tip region of a conventional solid fuel burner will be described. FIG. 4B illustrates the flow of air in the nozzle tip region of the conventional solid fuel burner. In the structure according to the prior art illustrated in FIG. 4B, the distal end position X1 of the guide ring 34 is at a closer side of the furnace 2 than the distal end position X2 of the guide sleeve 20. That is, the positional relationship according to the prior art is opposite to the positional relationship according to the first embodiment, and thus the guide sleeve 20 does not overlap with the guide ring 34. Here, the first angle θ1 of the guide sleeve 20 is set to be the same as the first angle θ1 of the first embodiment.

As illustrated in FIG. 4B, in the structure according to the conventional solid fuel burner, the secondary air 14 collides with the guide ring 34, and largely changes its direction outwardly in the radial direction. At this time, since the guide sleeve 20 does not overlap with the guide ring 34, the secondary air 14 largely flows outwardly in the radial direction together with the tertiary air 15, which makes a reducing flame region 50*b* large. As a result, although the effect of reducing NOx can be expected, the effect of reducing unburned combustibles of the solid fuel and the effect of reducing CO become low.

Next, with reference to FIG. 4A, the flow of air in the nozzle tip region of the solid fuel burner 5-1 according to the first embodiment will be described. FIG. 4A illustrates the flow of air in the nozzle tip region of the solid fuel burner 5-1. As illustrated in FIG. 4A, the primary air 13 is ejected from the fuel nozzle 10 into the furnace 2. The secondary air 14 flows in the secondary air nozzle 11, collides with the guide ring 34 of the flame stabilizer 23, and changes its direction outwardly in the radial direction. Since the distal end position X2 of the guide sleeve 20 is at a closer side of the furnace 2 than the distal end position X1 of the guide ring 34, the secondary air 14 which has collided with the guide ring 34 flows along the inner peripheral surface of the portion of the guide sleeve 20, in which the guide ring 34 overlaps with the guide sleeve 20 (portion indicated by A in FIG. 3), and then is ejected at the first angle θ1 with respect to the burner central axis C outwardly in the radial direction into the furnace 2. The tertiary air 15 flows in the tertiary air nozzle 12 and is ejected at the first angle θ1 with respect to the burner central axis C outwardly in the radial direction into the furnace 2 while changing its direction along the guide sleeve 20 toward the outer peripheral side thereof.

As described above, since the distal end position X2 of the guide sleeve 20 is at a closer side of the furnace 2 than the distal end position X1 of the guide ring 34, the guide sleeve 20 can suppress the secondary air 14 from being deflected outwardly in the radial direction. Furthermore, since the first angle θ1 of the guide sleeve 20 is set in the range of 10 degrees to 40 degrees, the secondary air 14 and the tertiary air 15 are deflected outwardly in the radial direction by the first angle θ1 of the guide sleeve 20, and then ejected into the furnace 2. As a result, a reducing flame region 50*a* can be made narrower than that of the above-mentioned prior art, thereby decreasing unburned combustibles of the solid fuel and reducing generation of CO.

As described above, in the solid fuel burner 5-1 according to the first embodiment, since the guide sleeve 20 overlaps with the guide ring 34, the secondary air 14 and the tertiary air 15 are suppressed from flowing outwardly in the radial direction. As a result, the reducing flame region 50*a* by the primary air 13 becomes smaller than that of the prior art, which makes it possible to decrease unburned combustibles of the solid fuel and reduce generation of CO. Furthermore, by setting the first angle θ1 of the guide sleeve 20 in the range of 10 degrees to 40 degrees, more preferably in the range of 20 degrees to 30 degrees, it is possible to balance the effect of reducing unburned combustibles of the solid fuel and CO and the effect of reducing NOx.

Still further, since the relationship between the length A, in which the guide sleeve 20 overlaps with the guide ring 34, and the gap 3 between the guide sleeve 20 and the guide ring 34 in the height direction is set to satisfy $A>0.5\times B$, the guide sleeve 20 reliably suppresses the secondary air 14 from flowing outwardly in the radial direction while allowing the secondary air 14 to flow therealong. As a result, the reducing flame region 50*a* can be formed suitably, thereby effectively suppressing unburned combustibles of the solid fuel and generation of CO.

Still further, since the secondary air 14 and the tertiary air 15 can be suppressed from flowing outwardly in the radial direction, mixing of the solid fuel ejected from the fuel nozzle 10 with the secondary air 14 and the tertiary air 15 is accelerated. Accordingly, the flame temperature increases, and thus heat absorption to the water wall 19 of the furnace 2 increases. As a result, the gas temperature at an outlet of the furnace 2 can be lowered, which is effective for suppressing slagging. In this connection, slagging refers to decrease in heat absorption and increase of pressure loss in the furnace, which occur due to adhesion of ashes melted by combustion to a furnace wall and/or a heat transfer pipe.

Figure 5:
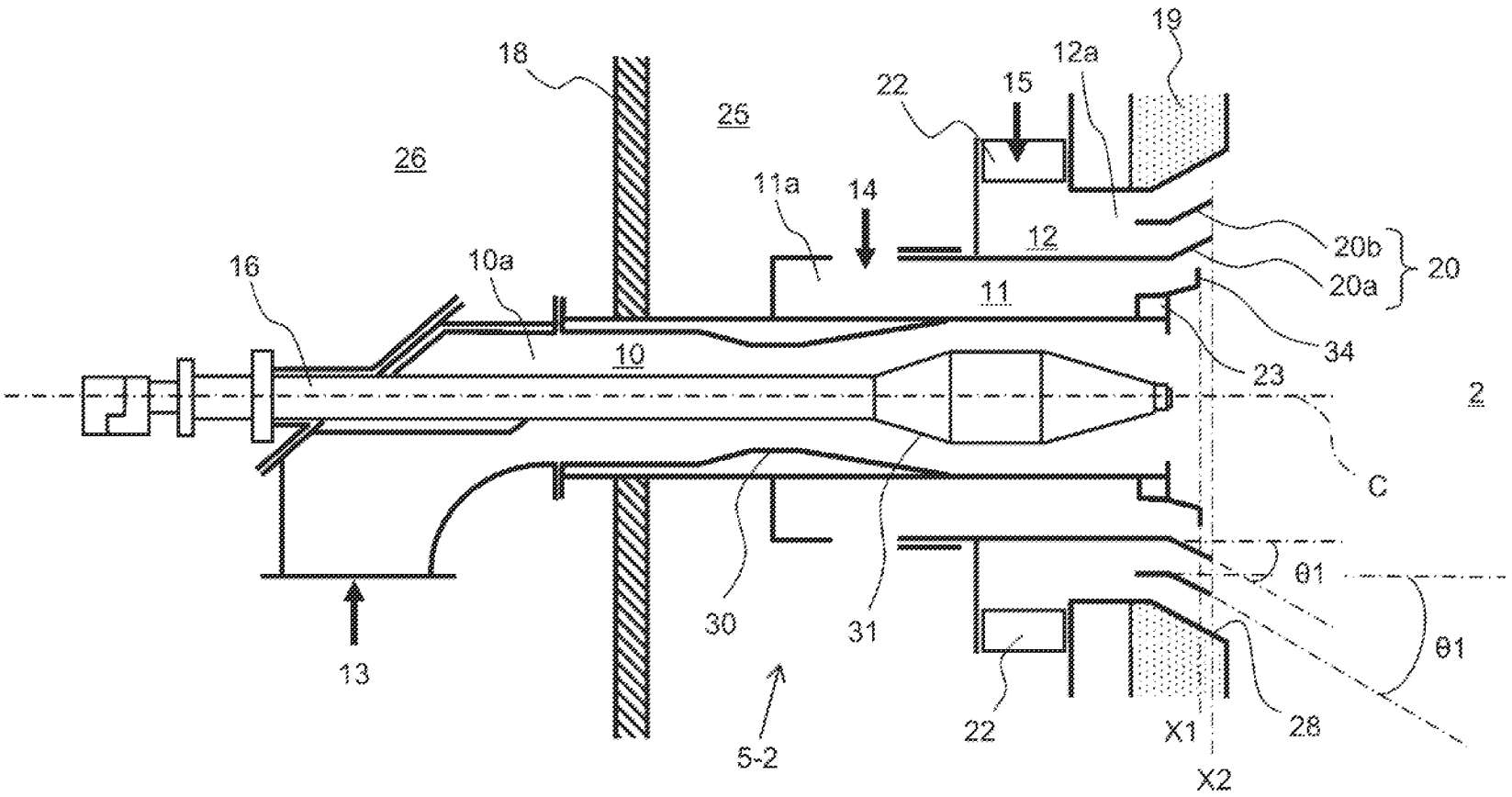
FIG. 5 is a schematic view of a solid fuel burner including two guide sleeves according to a modification of the first embodiment of the present invention.

Next, an example of a solid fuel burner 5-2 according to a modification of the first embodiment of the present invention, which includes a plurality of guide sleeves 20, will be described. FIG. 5 is a schematic view of the solid fuel burner 5-2 according to the present modification. In the following, the same components as those in the case of including one guide sleeve 20 are provided with the same reference signs, and explanation thereof will be omitted.

As illustrated in FIG. 5, the technical feature of the solid fuel burner 5-2 of the present modification can be found in a plurality of guide sleeves 20 (for example, guide sleeve 20*a* and guide sleeve 20*b*) which is provided with spaces therebetween in the radial direction of the tertiary air nozzle 12. These two guide sleeves 20*a*, 20*b* are held with a predetermined space formed therebetween by a spacer (not illustrated), and fixed by bolts (not illustrated) or welding. The first angle θ1 of the guide sleeve 20*a* and the first angle θ1 of the guide sleeve 20*b* are substantially the same, for example, set in a range of 10 degrees to 40 degrees, and more preferably within a range of 20 degrees to 30 degrees. Furthermore, the distal end position X2 of the guide sleeve 20*a* and the distal end position X2 of the guide sleeve 20*b* in the axial direction are on substantially the same position, and they are at a closer side of the furnace 2 than the distal end position X1 of the guide ring 34. Each of the guide sleeve 20*a* and the guide sleeve 20*b* is formed such that a portion on the upstream side of the tertiary air nozzle 12 is substantially parallel to the nozzle axial direction, in other words, has a cylindrical shape in which the diameter thereof is substantially constant, while a portion on the downstream side of the tertiary air nozzle 12 is expanded to have an expanded tubular shape spreading at the above-described first angle θ1.

In the solid fuel burner 5-2 according to the present modification, since the plurality of guide sleeves 20 introduces the tertiary air 15 outwardly in the radial direction by the first angle θ1, for example, when the width of an outlet portion of the tertiary air nozzle 12 in the radial direction is large (i.e., when the distance between the burner throat 28 and a distal end portion of a partition wall separating the secondary air flow path 11*a* and the tertiary air flow path 12*a* is large), it is possible to reliably restrict a flow direction of the tertiary air 15. As a result, as compared with the case where one guide sleeve 20 is provided, the tertiary air 15 can be reliably supplied into the furnace 2 at the predetermined angle θ1 by the guide sleeves 20, thereby ensuring the effect of reducing unburned combustibles of the solid fuel and the effect of reducing CO.

Second Embodiment

Figure 6:
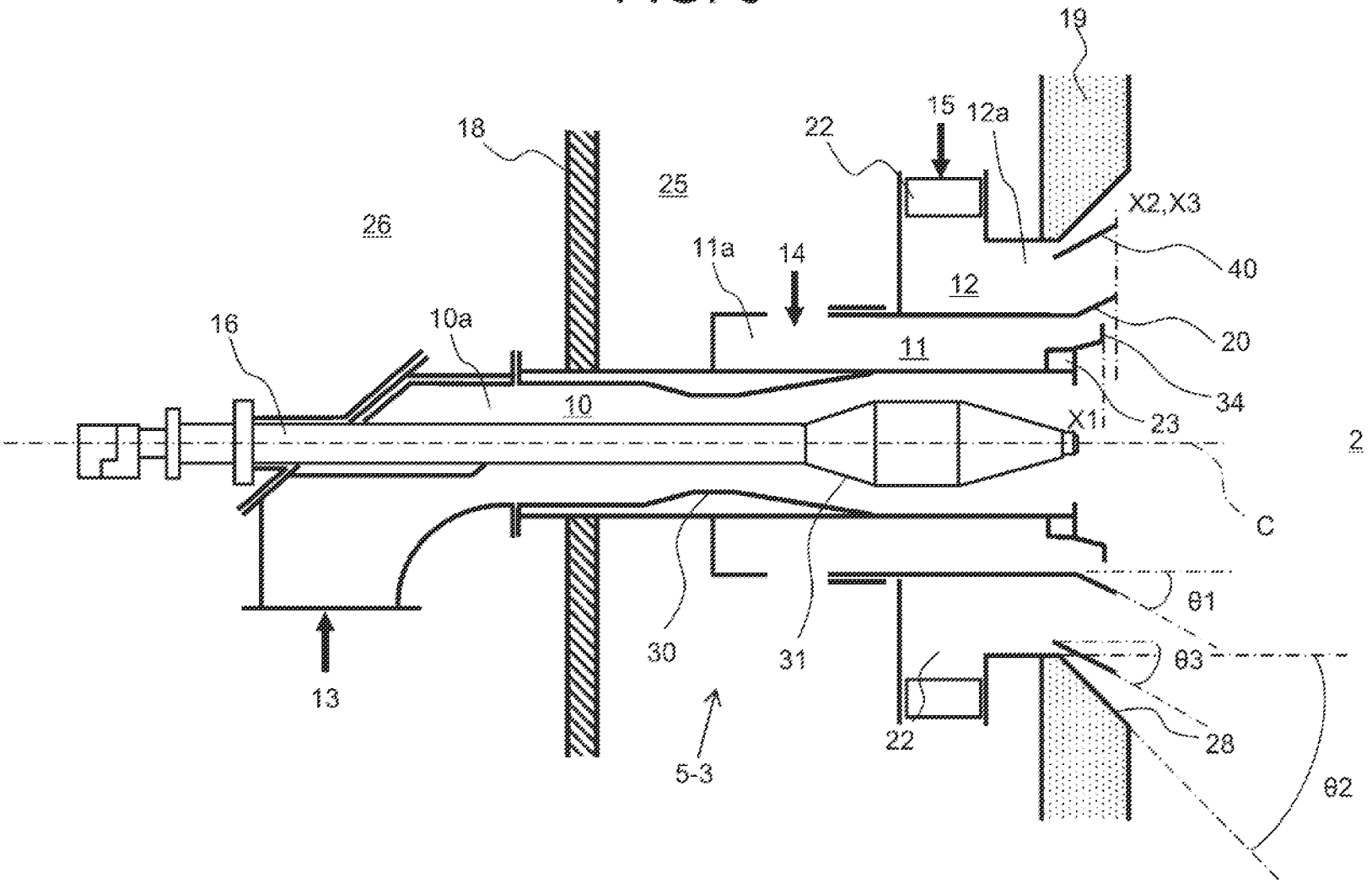
FIG. 6 is a schematic view of a solid fuel burner according to a second embodiment of the present invention.

Next, a solid fuel burner 5-3 according to a second embodiment of the present invention will be described. FIG. 6 is a schematic view of the solid fuel burner 5-3 according to the second embodiment. The same components as those of the first embodiment are provided with the same reference signs, and explanation thereof will be omitted. In the second embodiment, it is assumed that the second angle θ2 of the burner throat 28 is greater than the first angle θ1 of the guide sleeve 20. For example, it is assumed that the solid fuel burner 5-3 is provided on the burner throat 28 of existing boiler equipment, of which the second angle θ2 of is set to be about 45 degrees.

The solid fuel burner 5-3 is formed in the same manner as the first embodiment, meanwhile as illustrated in FIG. 6, the technical feature thereof can be found in a seal air introduction plate (seal air introduction member) 40 which is provided on a position between the guide sleeve 20 and the burner throat 28. The seal air introduction plate 40 is disposed to be inclined outwardly in the radial direction by a third angle θ3 with respect to the burner central axis C, and the third angle θ3 is substantially the same as the first angle θ1. That is, the guide sleeve 20 and the seal air introduction plate 40 are inclined at substantially the same angle. The first angle θ1 and the third angle θ3 are, for example, set in a range of 10 degrees to 40 degrees, and more preferably, set in a range of 20 degrees to 30 degrees. The guide sleeve 20 and the seal air introduction plate 40 are provided with a space formed therebetween in the radial direction by a spacer (not illustrated), and fixed by bolts (not illustrated) or welding. In this connection, setting of the space by the spacer and fixing of the seal air introduction plate 40 by the bolts or welding may be performed from the side of the burner throat 28 or the side of the member which is continuously connected to the burner throat 28. The distal end position X3 of the seal air introduction plate 40 in the axial direction is set to be substantially the same as the distal end position X2 of the guide sleeve 20.

Figure 7A:
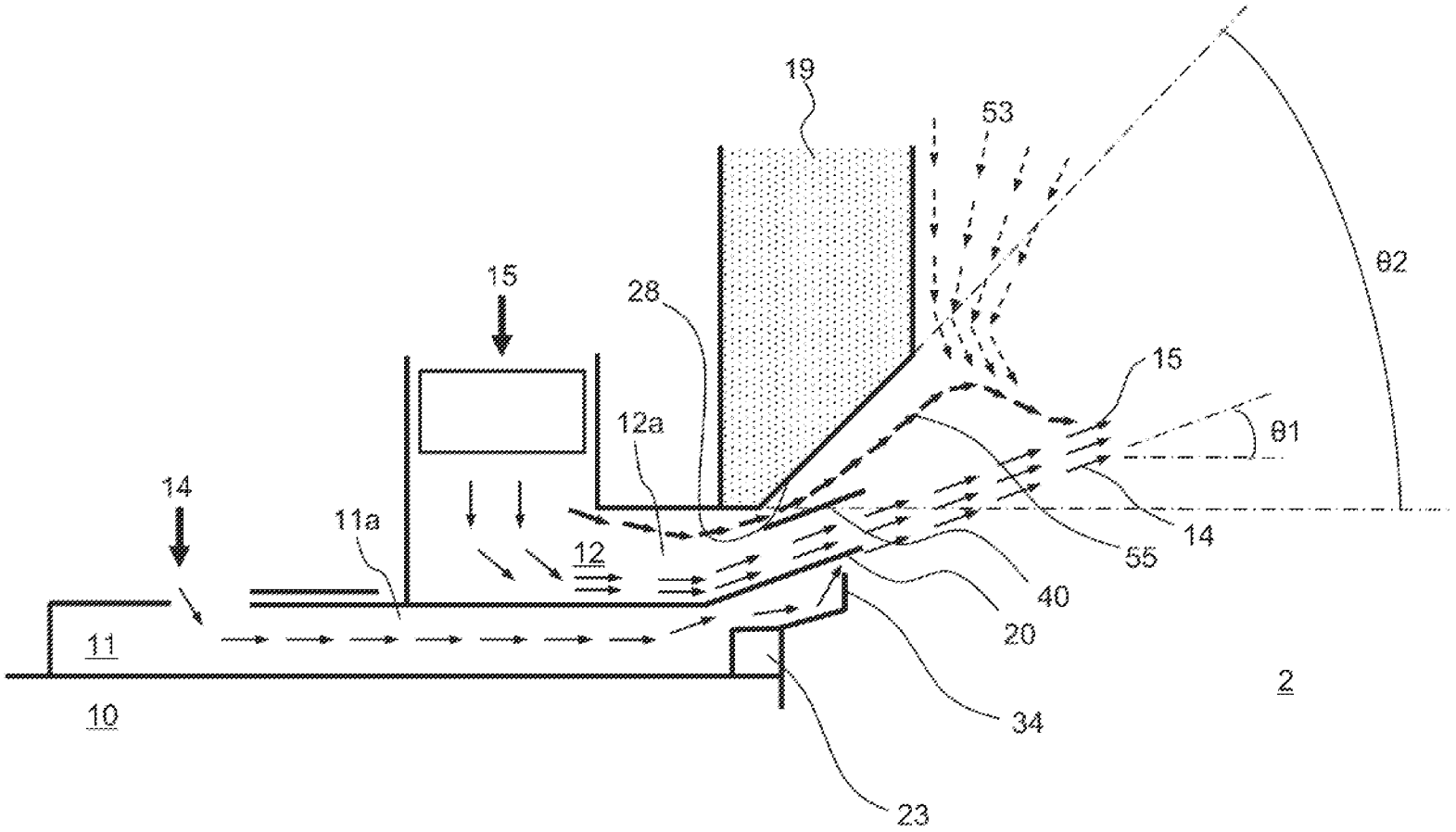
FIG. 7A illustrates a flow of air at a nozzle tip of the solid fuel burner according to the second embodiment of the present invention.
Figure 7B:
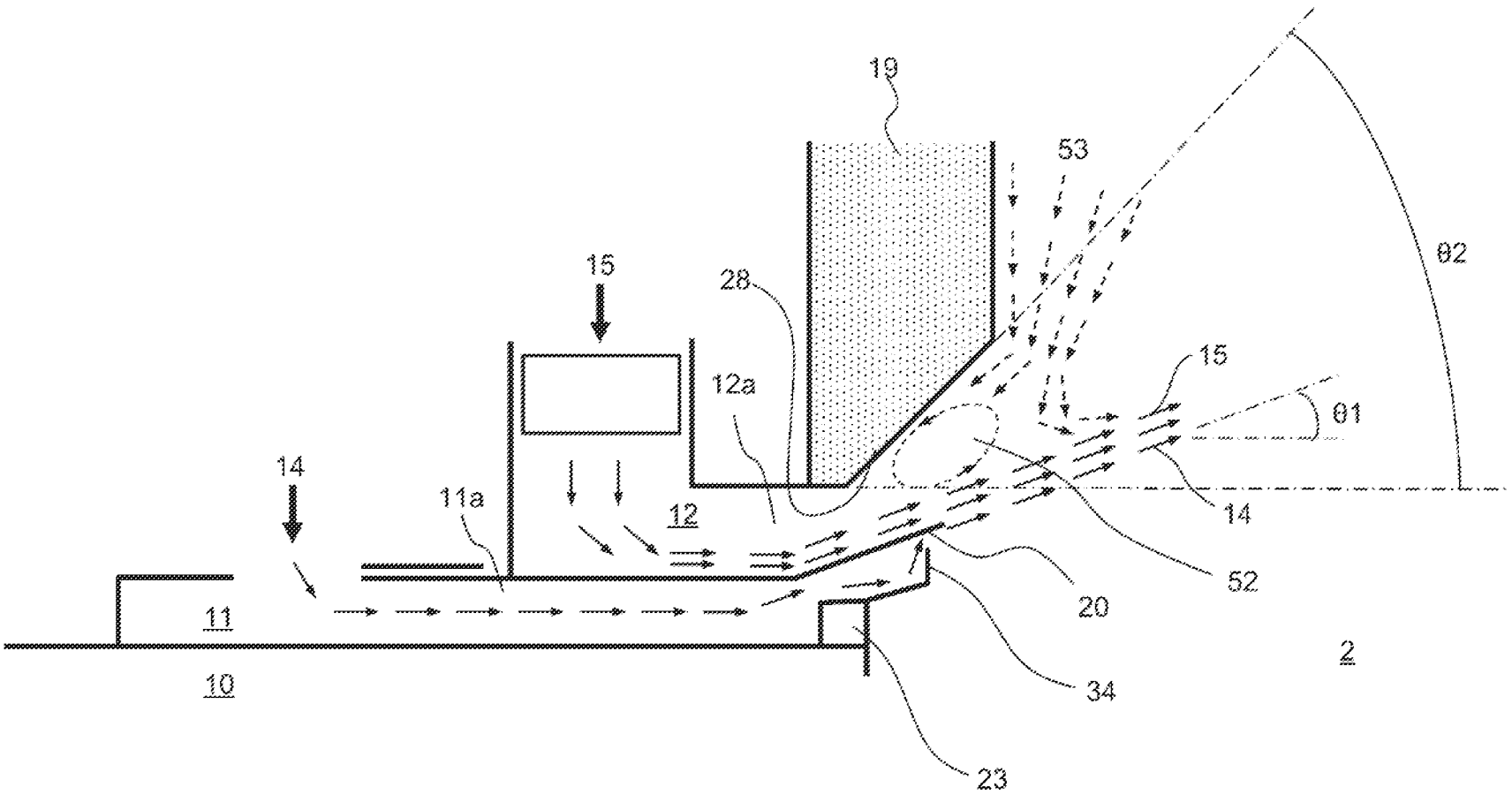
FIG. 7B illustrates a flow of air in a nozzle tip region of a solid fuel burner without including a seal air introduction plate.

Next, a flow of air in a nozzle tip region of the solid fuel burner 5-3 according to the second embodiment will be described while comparing it with that of a solid-fuel burner without including the seal air introduction plate 40. First, with reference to FIG. 7B, the flow of air in the case of the solid-fuel burner without including the seal air introduction plate 40 will be described. FIG 7B illustrates the flow of air in the nozzle tip region of the solid fuel burner without including the seal air introduction plate 40. In FIG. 7B, flows of the secondary air 14 and the tertiary air 15 are indicated by arrows of solid lines, and flows of gas in the furnace 2 are indicated by arrows of dashed lines, respectively.

As illustrated in FIG. 7B, the secondary air 14 flows in between the flame stabilizer 23 and the guide sleeve 20 through the secondary air flow path 11*a*, collides with the guide ring 34, and spreads outwardly in the radial direction. Then, the secondary air 14 collides with the inner peripheral surface of the guide sleeve 20, and is supplied to the furnace 2 at an angle which is substantially the same as the angle (first angle θ1) of the guide sleeve 20.

After being restricted by the tertiary air flow path 12*a*, the tertiary air 15 is supplied to the furnace 2 along the outer peripheral side of the guide sleeve 20 with the inclination which is substantially the same as the inclination (first angle θ1) of the guide sleeve 20. The secondary air 14 and the tertiary air 15 are supplied to the furnace 2 at the inclination which is substantially the same as the inclination (first angle θ1) of the guide sleeve 20. After passing through the outlet of the guide sleeve 20, the flow of the secondary air 14 and the flow of the tertiary air 15 are integrated.

Here, as described above, the second angle θ2 of the burner throat 28 is about 45 degrees and is greater than the first angle θ1 (for example, 10 degrees to 40 degrees) of the guide sleeve 20. Accordingly, a circulating flow 52 is formed between a spreading portion of the burner throat 28 and the integrated flow of the secondary air 14 and the tertiary air 15 by an entrainment phenomenon of surrounding fluid generated into the integrated flow of the secondary air 14 and the tertiary air 15. In the space of the furnace 2 near the burner, a large circulating flow 53 is generated by entrainment phenomenon of surrounding fluid into the integrated flow of the secondary air 14 and the tertiary air 15. A part of the circulating flow 53 is merged into the circulating flow 52 formed in the burner throat 28, and the most of the circulating flow 53 is entrained into the integrated flow of the secondary air 14 and the tertiary air 15 in the furnace.

The circulating flow 53 in the furnace 2 contains melted combustion ashes, and a part of the combustion ashes flows into the circulating flow 52 formed near the burner throat 23. Accordingly, in the case of the solid fuel burner without including the seal air introduction plate 40, there is a possibility that the melted ashes are gradually fixed to the burner throat 28 and large clinker is formed. The large clinker may change a flow state of the integrated flow of the secondary air 14 and the tertiary air 15, or block a flow path of the air.

Next, with reference to FIG. 7A, the flow of air in the nozzle tip region of the solid fuel burner 5-3 according to the second embodiment will be described. FIG. 7A illustrates a flow of air at the nozzle tip of the solid fuel burner 5-3 according to the second embodiment. Since the solid fuel burner 5-3 according to the second embodiment includes the seal air introduction plate 40, the flow of air in the nozzle tip region is different from that illustrated in FIG. 7B. More specifically, in the solid fuel burner 5-3 according to the second embodiment, the secondary air 14 and the tertiary air 15 are integrated and then ejected at an angle which is substantially the same as the spread angle of the guide sleeve 20. Since the seal air introduction plate 40 has the spread angle equivalent to that of the guide sleeve 20, the circulating flow 52 is not formed inside the seal air introduction plate 40.

Between the seal air introduction plate 40 and the burner throat 28, seal air 55 (indicated by thick lines in FIG. 7A) which is a part of the tertiary air 15 is introduced. The seal air 55 is spread outwardly in the radial direction by the seal air introduction plate 40, flows between the seal air introduction plate 40 and the burner throat 28, and then is supplied to the furnace 2. The flow of the seal air 55 suppresses formation of a circulation region of the burner throat 28. After being supplied to the furnace 2, the seal air 55 is entrained into the integrated flow of the secondary air 14 and the tertiary air 15. The circulating flow (return flow) 53 of the high temperature gas in the furnace 2 is carried on the flow of the seal air 55 in the furnace 2, and thus is also entrained into the integrated flow of the secondary air 14 and the tertiary air 15. Accordingly, the melted gases in the high temperature gas in the furnace 2 are suppressed from flowing in the burner side, thereby preventing adhesion of the ashes to the vicinity of the burner throat 28.

As described above, according to the solid fuel burner 5-3 of the second embodiment, since the reducing flame region 50*a* can be narrowed in the same manner as the first embodiment, it is possible to reduce unburned combustibles of the solid fuel and CO. Furthermore, even if replacing a solid fuel burner attached to existing boiler equipment with the solid fuel burner 5-3 according to the second embodiment, since the solid fuel burner 5-3 includes the seal air introduction plate 40, ash adhesion to the vicinity of the burner throat 28 can be suppressed. That is, the solid fuel burner 5-3 according to the second embodiment is a structure suitable for modifying the existing boiler equipment.

Third Embodiment

Figure 8:
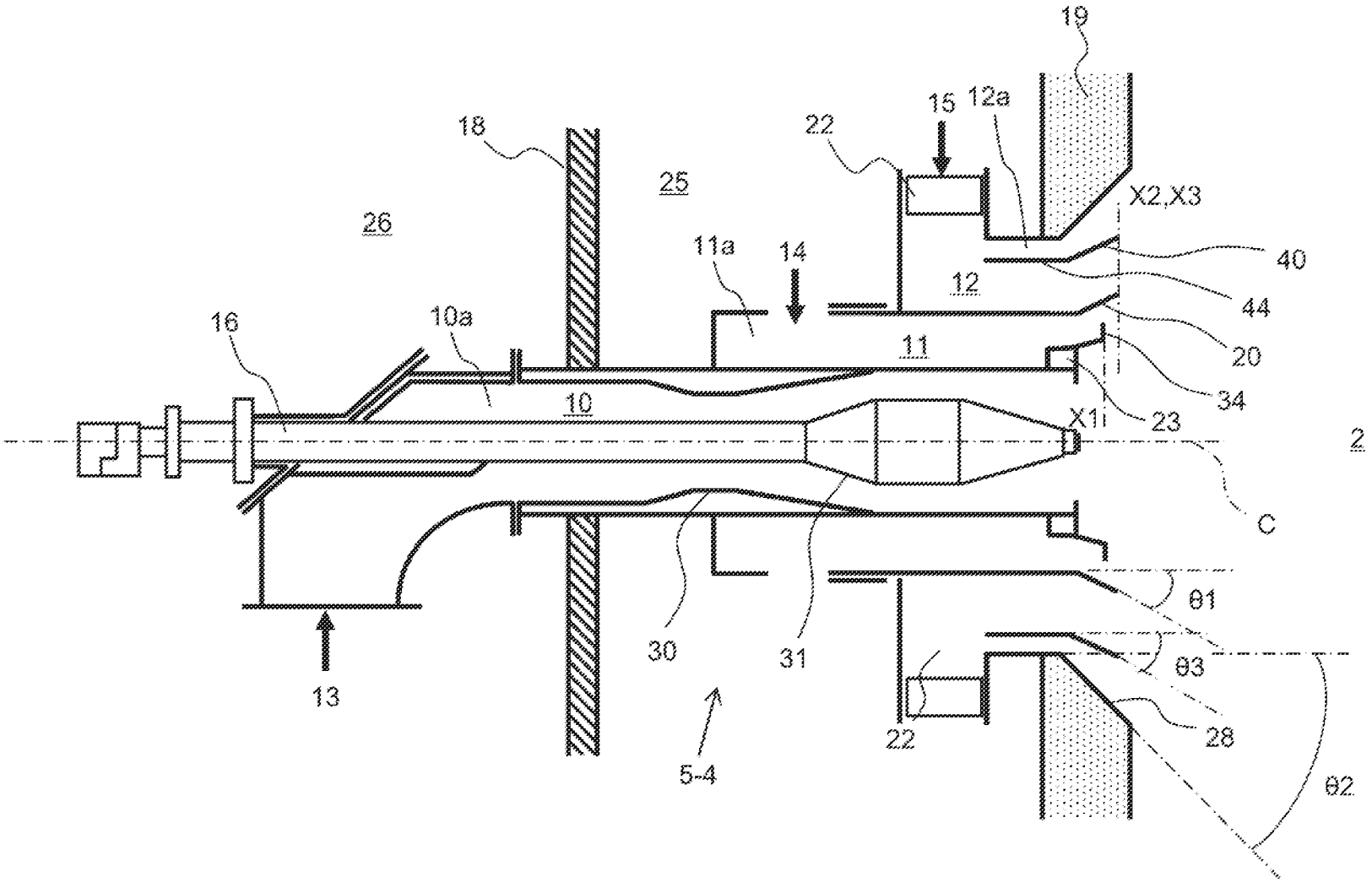
FIG. 8 is a schematic view of a solid fuel burner according to a third embodiment.

Next, a solid fuel burner 5-4 according to a third embodiment of the present invention will be described. FIG. 8 is a schematic view of the solid fuel burner 5-4 according to the third embodiment. The same components as those of the first and second embodiments are provided with the same reference signs, and explanation thereof will be omitted. As illustrated in FIG. 8, the solid fuel burner 5-4 according to the third embodiment is formed in the same manner as the solid fuel burner 5-3 of the second embodiment, meanwhile, the technical feature thereof can be found in a seal air leading cylindrical portion (seal air leading member) 44 which is provided on a rear end portion of the seal air introduction plate 40 (end portion at the upstream side of the flow of the tertiary air 15).

As illustrated in FIG. 8, since being introduced in a direction perpendicular to the burner central axis C, the tertiary air 15 is easy to flow between the guide sleeve 20 and the seal air introduction plate 40. In the third embodiment, in order to lead the seal air to the radial outside of the seal air introduction plate 40 more reliably, the seal air leading cylindrical portion 44 is provided. The seal air leading cylindrical portion 44 is formed such that the body thereof has a cylindrical shape which extends parallel to the axial direction of the tertiary air nozzle 12, in other words, the diameter thereof is substantially constant, and is connected to the downstream side of the seal air introduction plate 40. With this configuration, a part of the tertiary air 15 is reliably led, as sealing air, to a flow path between the seal air introduction plate 40 and the burner throat 28 so as to prevent generation of the circulating flow 52 (see FIG. 7B), which results in an advantage that ashes hardly adhere to the vicinity of the burner throat 28. In this connection, the length of the seal air leading cylinder portion 44 can be arbitrarily designed so as to supply the seal air suitably, and thus it may be formed to protrude toward a space on the side where the swirler 22 is disposed.

Fourth Embodiment

Next, a solid fuel burner 5-5 according to a fourth embodiment of the present invention will be described. FIG.

Figure 9:
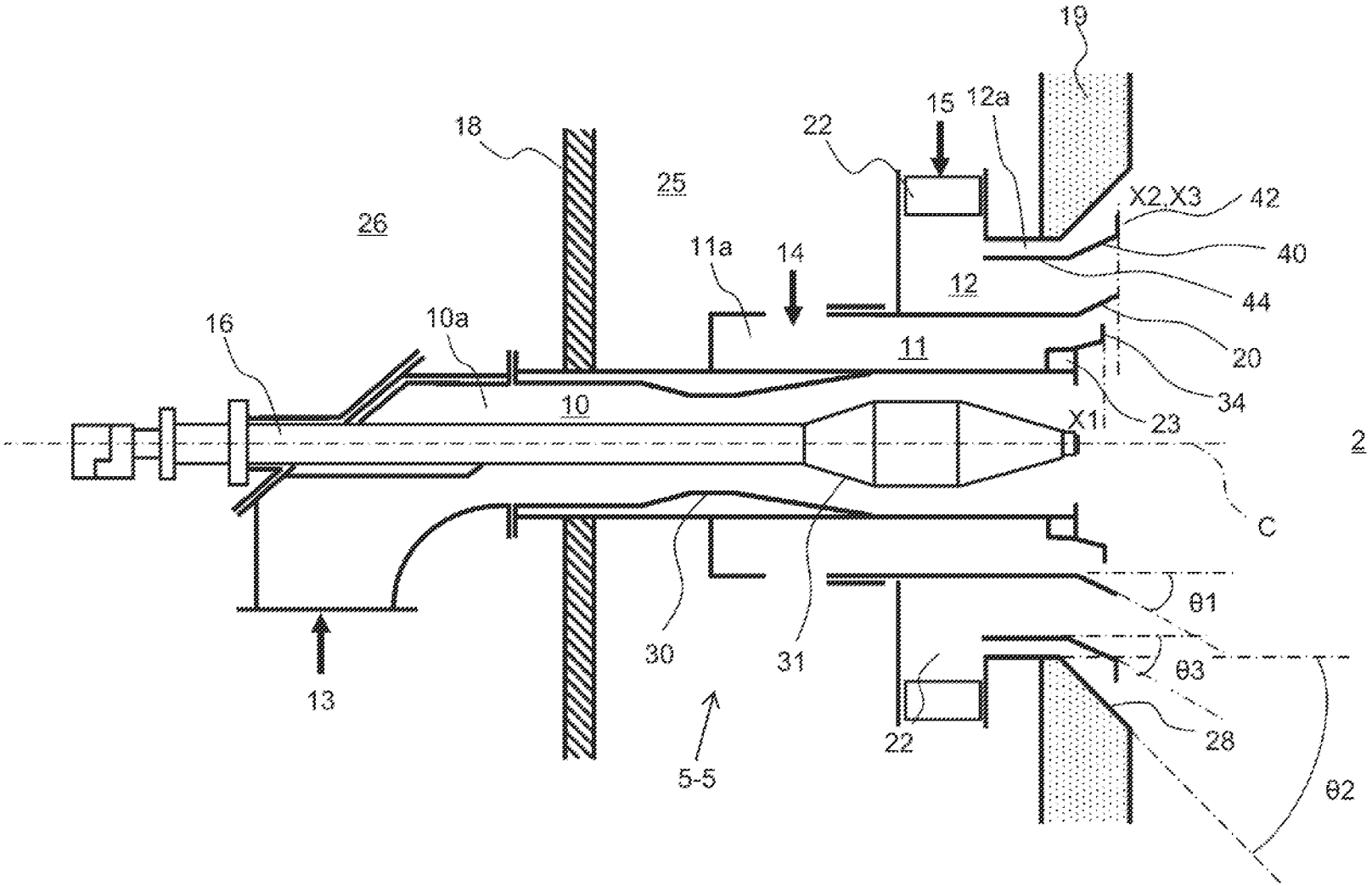
FIG. 9 is a schematic view of a solid fuel burner according to a fourth embodiment.

9 is a schematic view of the solid fuel burner 5-5 according to the fourth embodiment. The same components as those of the first to third embodiments are provided with the same reference signs, and explanation thereof will be omitted. As illustrated in FIG. 9, the solid fuel burner 5-5 according to the fourth embodiment is formed in the same manner as the solid fuel burner 5-4 of the third embodiment, meanwhile, the technical feature thereof can be found in a seal air deflection plate (seal air deflection member) 42 which is provided on a front end portion of the seal air introduction plate 40 (end portion on the downstream side of the flow of the tertiary air 15). The seal air deflection plate 42 extends outwardly in the radial direction from the front end portion of the seal air introduction plate 40, and includes a plane which is substantially perpendicular to the burner central axis C.

Figure 10:
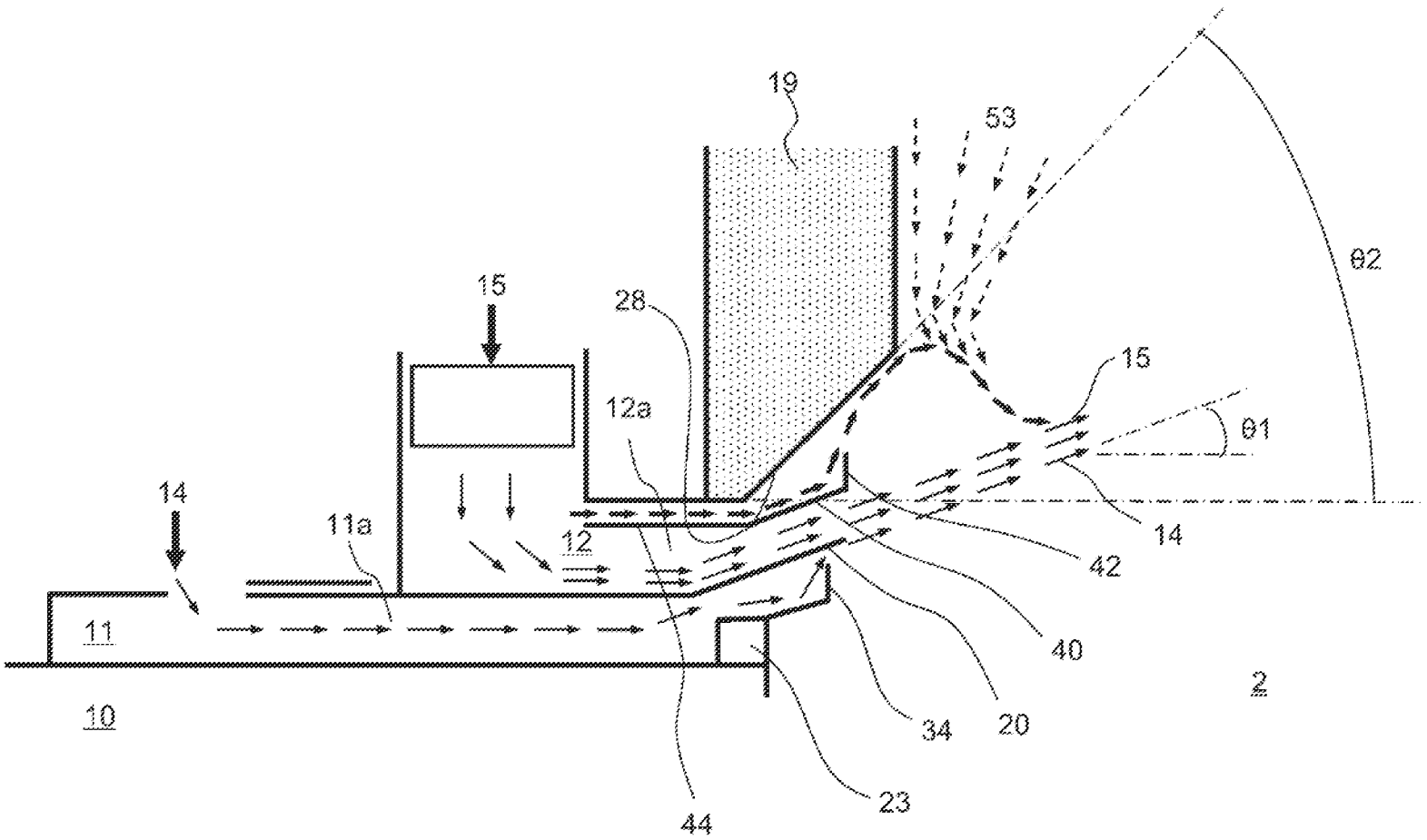
FIG. 10 illustrates a flow of air at a nozzle tip of the solid fuel burner according to the fourth embodiment of the present invention.

Next, with reference to FIG. 10, a flow of air in the nozzle tip region of the solid fuel burner 5-5 according to the fourth embodiment will be described. FIG. 10 illustrates the flow of air at the nozzle tip of the solid fuel burner 5-5 according to the fourth embodiment. According to the solid fuel burner 5-5 of the fourth embodiment, the seal air led by the seal air leading cylindrical portion 44 is flown by the seal air introduction plate 40 outwardly in the radial direction by the third angle θ3 (≈ θ1) with respect to the burner central axis C, collides with the seal air deflection plate 42, and then is further deflected outwardly in the radial direction. With this configuration, as compared with the second and third embodiments, it is possible to prevent generation of the circulating flow 52 (see FIG. 7B) more reliably, and thus adhesion of ashes to the vicinity of the burner throat 28 can be further prevented.

Fifth Embodiment

Figure 11:
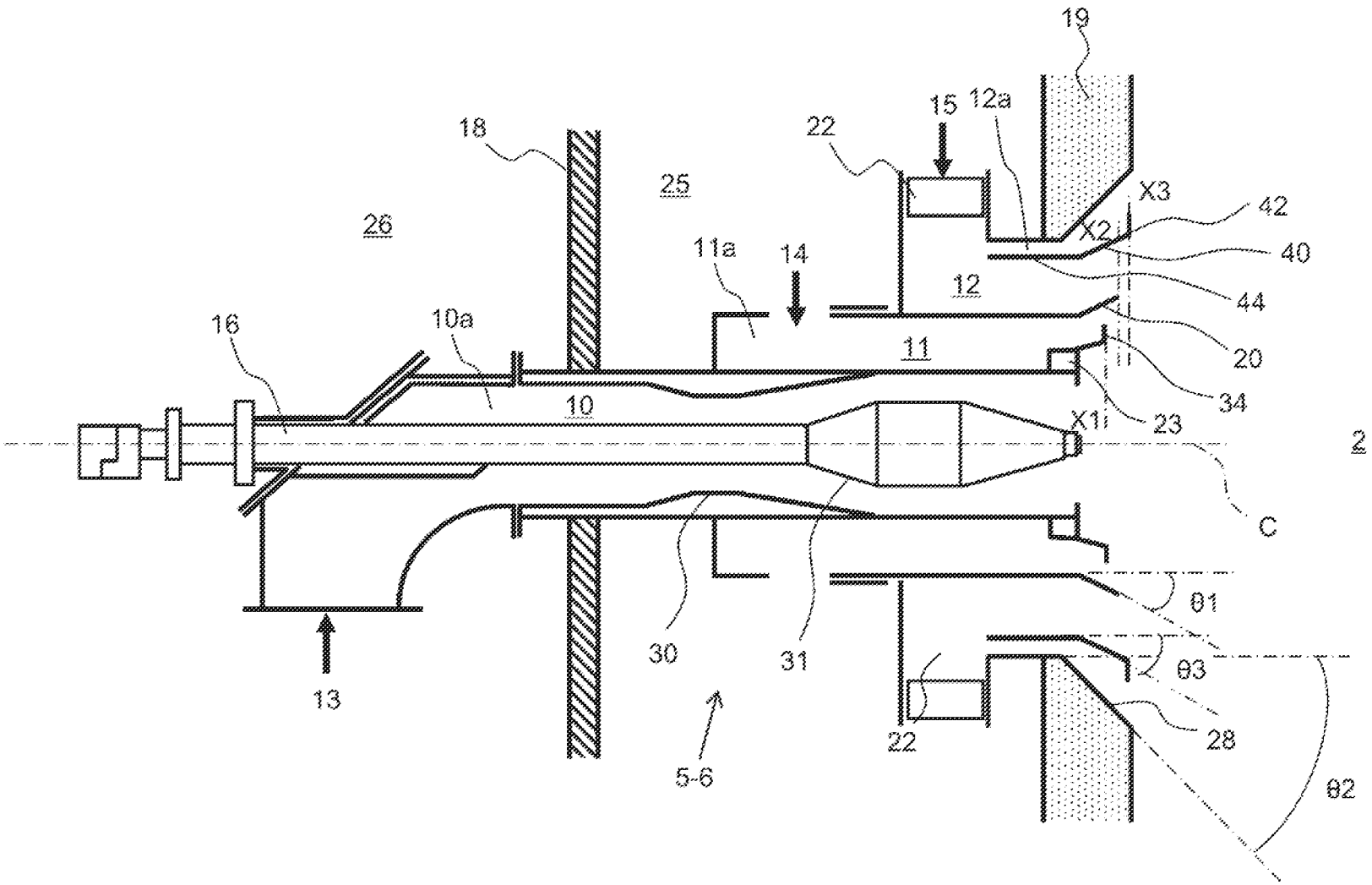
FIG. 11 is a schematic view of a solid fuel burner according to a fifth embodiment of the present invention.

Next, a solid fuel burner 5-6 according to a fifth embodiment of the present invention will be described. FIG. 11 is a schematic view of the solid fuel burner 5-6 according to the fifth embodiment. The same components as those of the first to fourth embodiments are provided with the same reference signs, and explanation thereof will be omitted. As illustrated in FIG. 11, the solid fuel burner 5-6 according to the fifth embodiment is different from the solid fuel burner 5-5 according to the fourth embodiment in that a distal end position X3 of the seal air introduction plate 40 is at a closer side of the furnace 2 in the axial direction than the distal end position X2 of the guide sleeve 20. Meanwhile, the distal end position X3 of the seal air introduction plate 40 does not project inwardly from the inner peripheral surface of the water wall 19 of the furnace 2.

According to the fifth embodiment, since the distal end position X3 of the seal air introduction plate 40 is positioned at a slightly closer side of the furnace 2 than the distal end position X2 of the guide sleeve 20, it is possible to further suppress the secondary air 14 and the tertiary air 15 from spreading outwardly in the radial direction. As a result, the reducing flame region 50*a* can be reliably narrowed as compared with that of the fourth embodiment, and the effect of reducing unburned combustibles of the solid fuel and CO is further enhanced.

Figure 12:
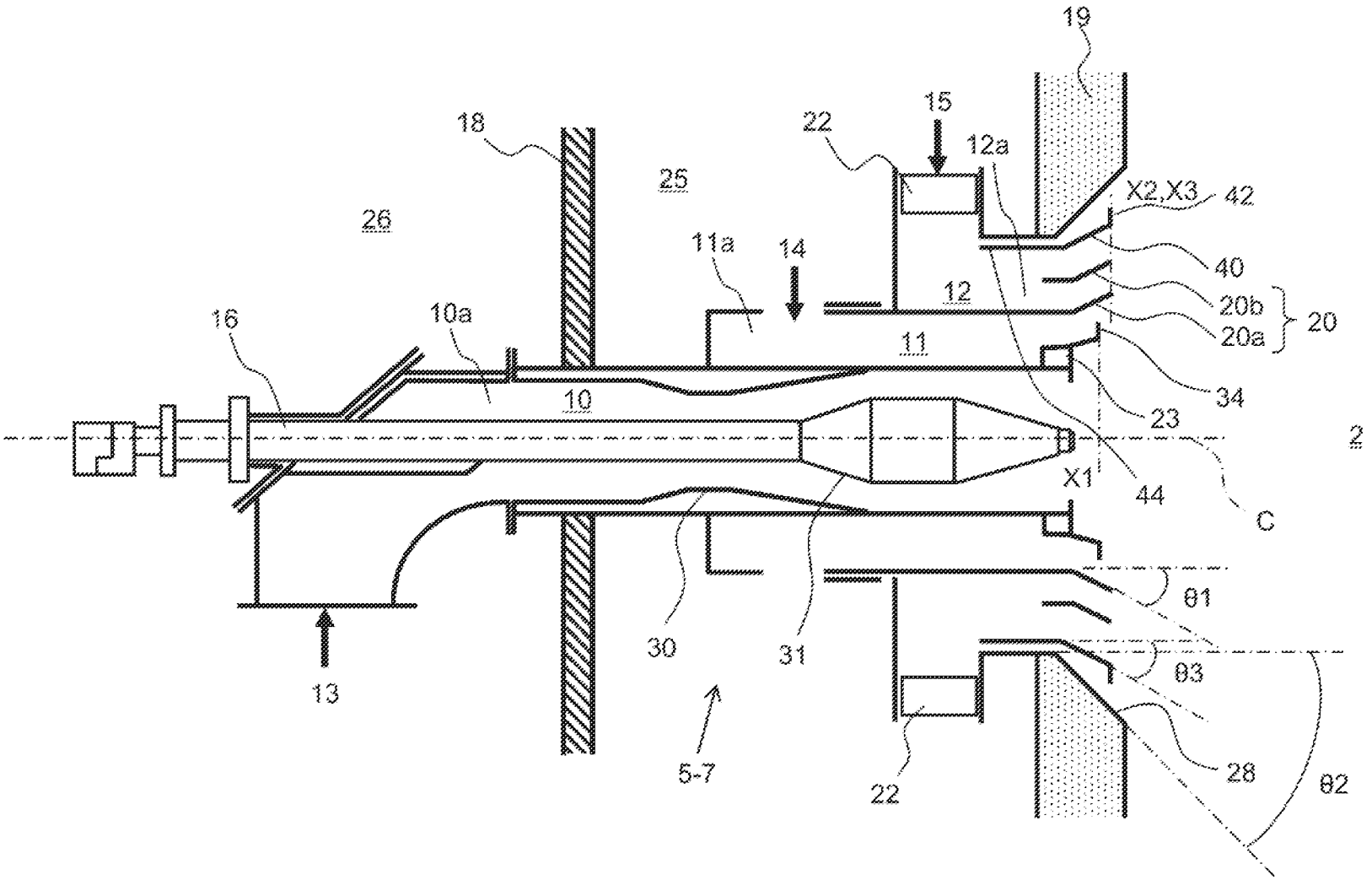
FIG. 12 is a schematic view of a solid fuel burner including two guide sleeves according to a modification of the second to fifth embodiments of the present invention.

Next, an example of a solid fuel burner 5-7 including a plurality of guide sleeves 20 according to a modification of the second to fifth embodiments of the present invention will be described. FIG. 12 is a schematic view of the solid fuel burner 5-7 according to the present modification. The same components as those of the solid fuel burner including a single guide sleeve 20 are provided with the same reference signs, and explanation thereof will be omitted. As illustrated in FIG. 12, the solid fuel burner 5-7 of the present modification is formed in the same manner as the solid fuel burners 5-3 according to the second to fifth embodiments, meanwhile, the technical feature thereof can be found in a plurality of guide sleeves 20 (for example, guide sleeve 20*a* and guide sleeve 20*b*) which is provided in the radial direction. The distal end position X2 of each of the guide sleeves 20*a*, 20*b* and the distal end position X3 of the seal air introduction plate 40 are on the substantially same position in the axial direction. The seal air introduction structure illustrated in FIG. 12 is based on the fourth embodiment (see FIG. 9).

According to the present modification, since the plurality of guide sleeves 20, i.e., the guide sleeve 20*a* and the guide sleeve 20*b* are provided in the radial direction, for example, when the width of the outlet portion of the tertiary air nozzle 12 in the radial direction is large (i.e., when the distance between the burner throat 28 and the distal end portion of the partition wall separating the secondary air flow path 11*a* and the tertiary air flow path 12*a* is large), it is possible to reliably restrict the flow direction of the tertiary air 15. As a result, as compared with the case where one guide sleeve 20 is provided, the tertiary air 15 can be reliably supplied into the furnace 2 at the predetermined angle θ1 by the guide sleeve 20*a* and the guide sleeve 20*b*, thereby ensuring the effect of reducing unburned combustibles of the solid fuel and CO.

Figure 13:
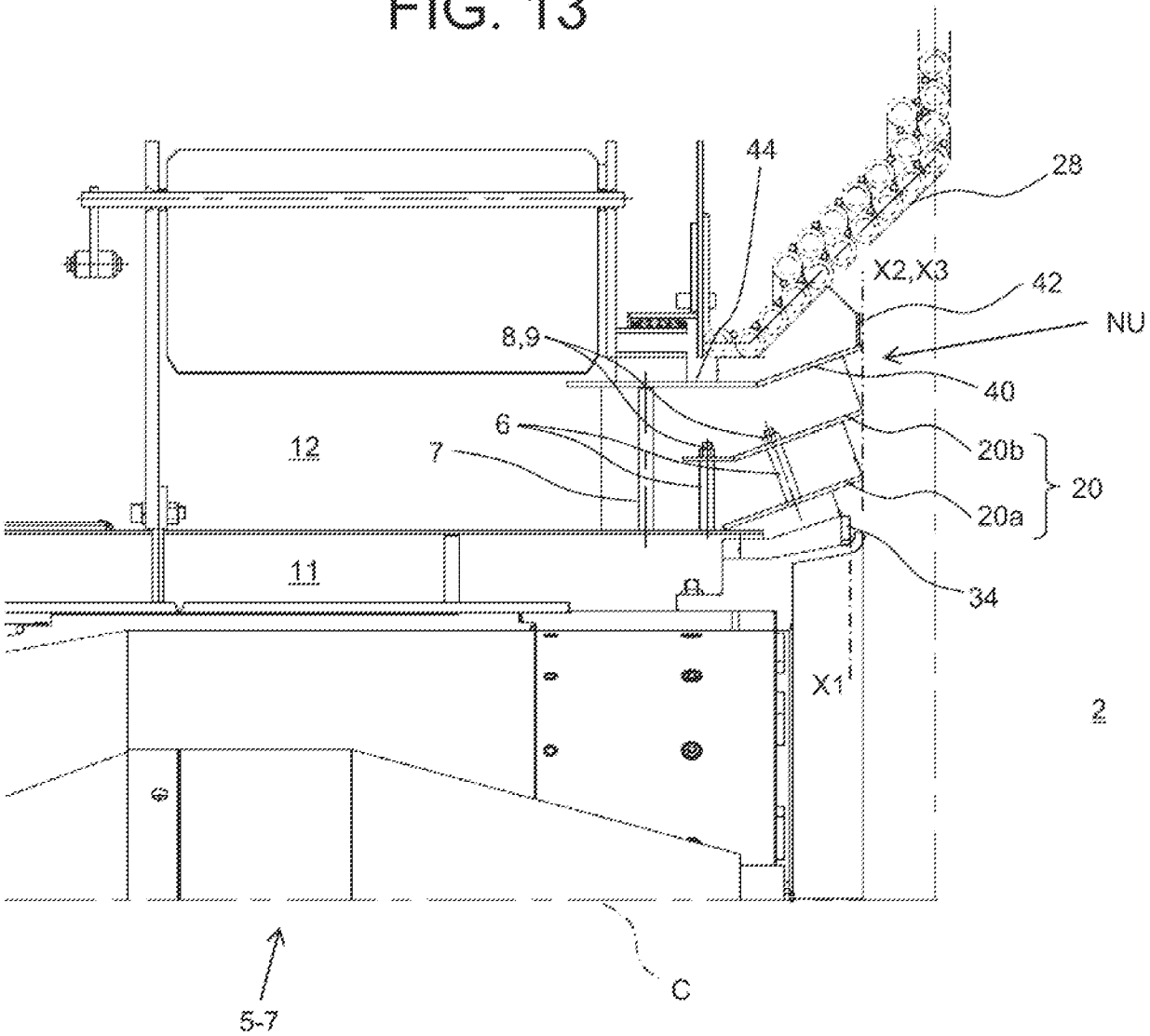
FIG. 13 is a cross-sectional view of a main part of the solid fuel burner illustrated in FIG. 12.

FIG. 13 is a cross-sectional view of a main part of the solid fuel burner 5-7 illustrated in FIG. 12. As illustrated in FIG. 13, in the solid fuel burner 5-7 of the present modification, the two guide sleeves (combustion gas guide member) 20*a*, 20*b* are mounted on the solid fuel burner 5-7 with a predetermined space therebetween through the spacer 6, and fixed thereto by bolts 8 and nuts 9. The seal air leading cylindrical portion (seal gas guide member) 44 is provided with a support 7. The support 7 is provided for positioning a space between the seal air leading cylindrical portion 44 and the outer peripheral surface of the secondary air nozzle 11 in the radial direction. The seal air leading cylindrical portion 44, the seal air introduction plate (seal gas introduction member) 40, and the seal air deflection plate (seal gas deflection member) 42 are integrated, and the two guide sleeves 20 (20*a*, 20*b*) are also integrated therewith through the spacer 6. Since the two guide sleeves 20*a*, 20*b* and the seal air introduction plate 40 are integrated, these components form a nozzle tip unit NU (guide vane unit) for one solid fuel burner.

The nozzle tip unit NU is detachably disposed on the outer peripheral side of the secondary air nozzle 11, and by fitting the nozzle tip unit NU to the secondary air nozzle 11 from the outside, positioning in the radial direction is performed by the support 7 provided in the seal air leading cylindrical portion 44. Since the distal end positions X1, X2, X3 in the axial direction are also fixed in an appropriate positional relationship in advance, attachment of the nozzle tip unit NU is completed only by fitting the nozzle tip unit NU into the distal end portion of the secondary air nozzle 11 and fixing it to the secondary air nozzle 11 using an arbitrary fixing means.

According to the present modification, since the components such as the guide sleeve 20 and the seal air introduction plate 40 are unitized by the nozzle tip unit NU, assembly and disassembly work can be simplified. In this connection, the nozzle tip unit NU may be fixed directly or indirectly to the burner throat 28. Furthermore, the nozzle tip unit NU may be fixed by integrating the seal air leading cylindrical portion 44, the seal air introduction plate 40, and the seal air deflection plate 42 as a first unit, integrating the two guide sleeves 20*a*, 20*b* as a second unit which is different unit from the first unit, fixing the first unit to the burner throat 28 or a member continuously connected to the burner throat 28, and then fixing the second unit to the secondary air nozzle 11.

Sixth Embodiment

Figure 14:
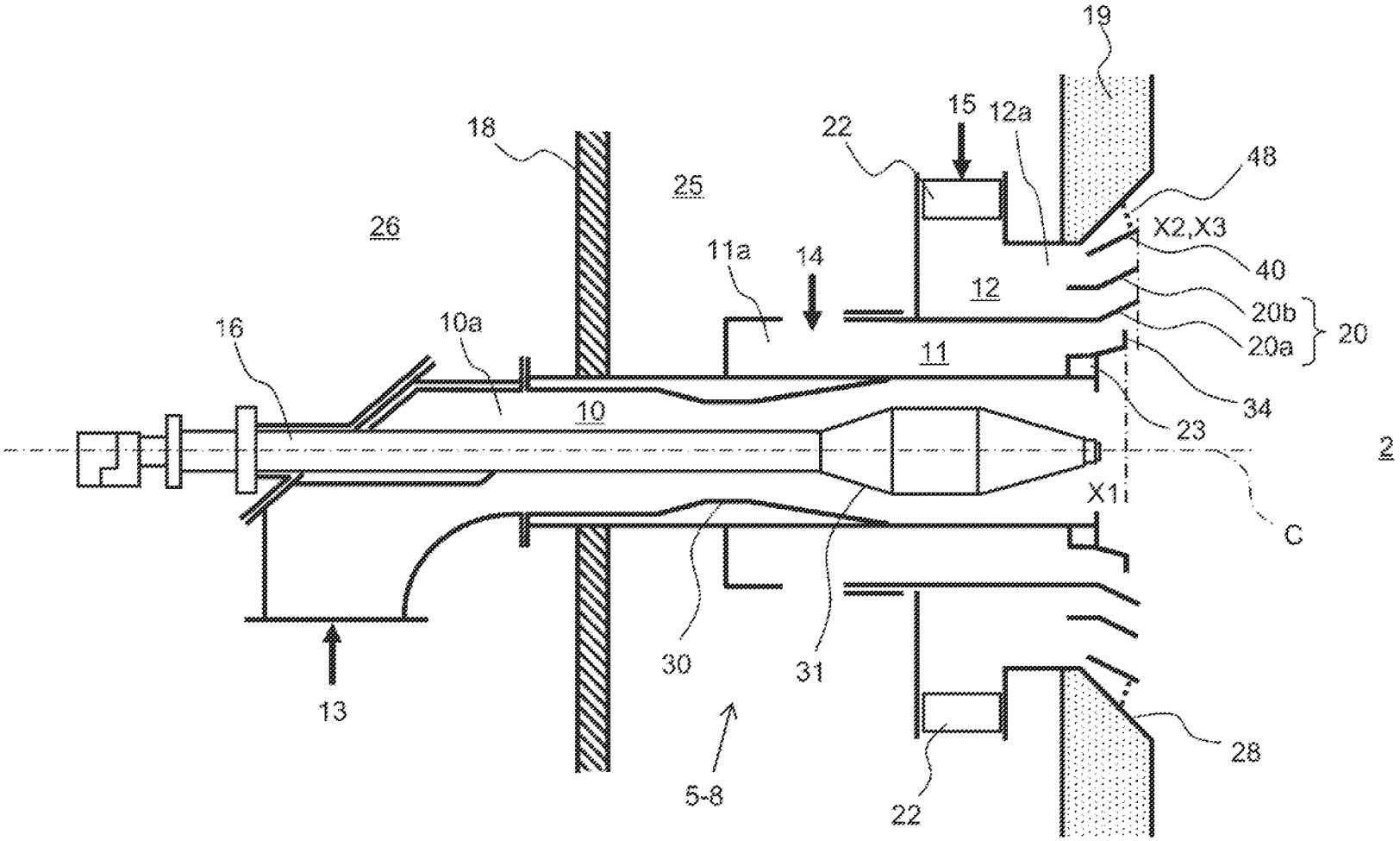
FIG. 14 is a schematic view of a solid fuel burner according to a sixth embodiment of the present invention.

Next, a solid fuel burner 5-8 according to a sixth embodiment of the present invention will be described. FIG. 14 is a schematic view of the solid fuel burner 5-8 according to the sixth embodiment. The same components as those of the first to fifth embodiments are provided with the same reference signs, and explanation thereof will be omitted. As illustrated in FIG. 14, the solid fuel burner 5-8 according to the sixth embodiment is formed in the same manner as the solid fuel burner 5-3 according to the second embodiment, meanwhile, the technical feature thereof can be found in a seal air deflection suppressing plate (seal air deflection suppressing member) 48 which is provided between the seal air introduction plate 40 and the burner throat 28 so as to suppress deflection of the seal air. The seal air deflection suppressing plate 48 is formed by, for example, a punching plate on which a large number of holes are provided, or a plate on which a large number of slits are provided.

With the seal air deflection suppressing plate 48, the seal air introduced toward the outside of seal air introduction plate 40 in the radial direction is made to flow uniformly and supplied to the furnace 2. As a result, it is possible to prevent generation of the circulating flow 52 and thus prevent adhesion of ashes to the vicinity of the burner throat 28. Furthermore, with the seal air deflection suppressing plate 48, it is not necessary to provide a seal air deflection plate 42. That is, the seal air deflection suppressing plate 48 is a member which is replaceable with the seal air deflection plate 42 used in the fourth and fifth embodiments.

Seventh Embodiment

Figure 15:
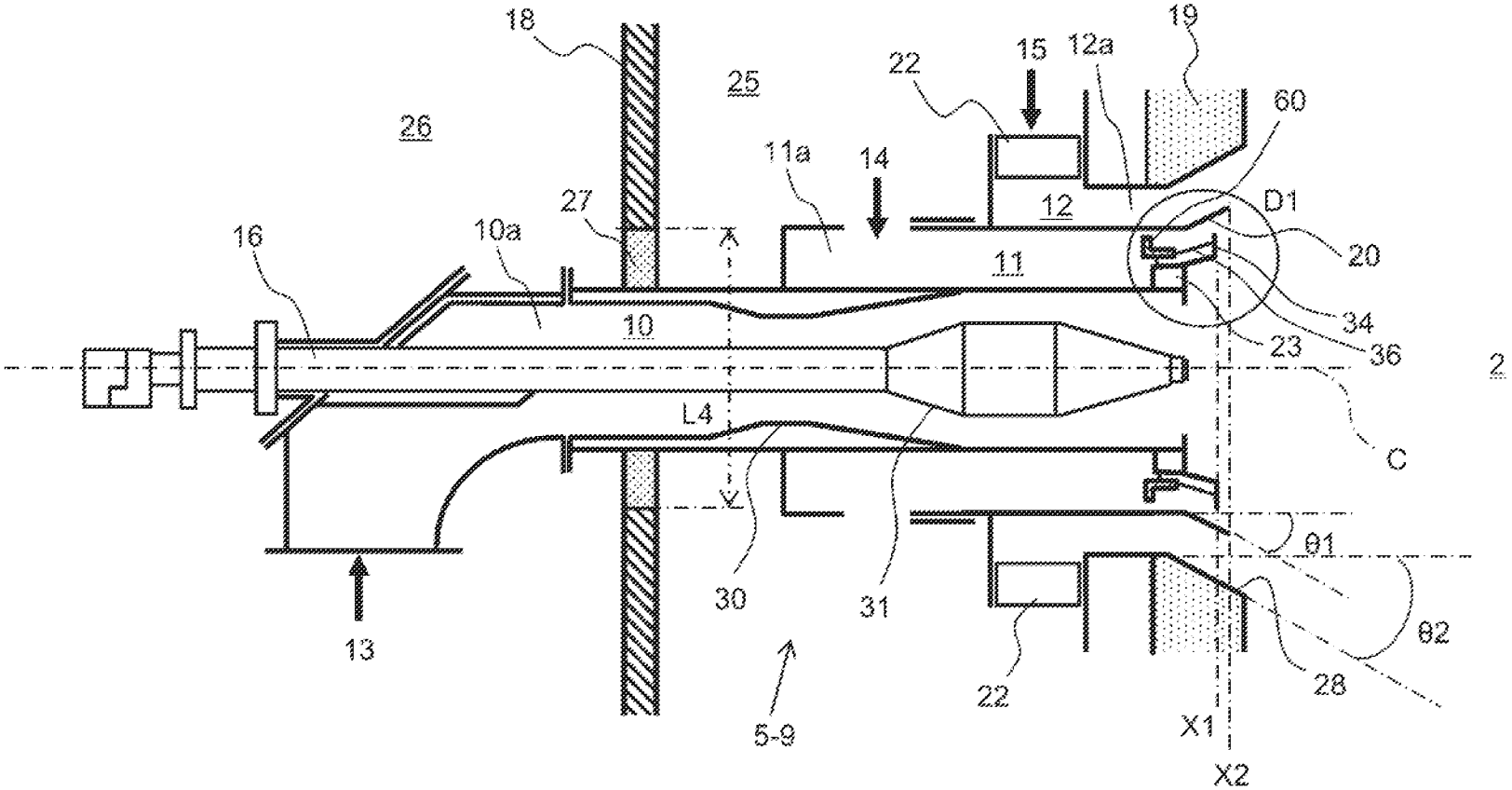
FIG. 15 is a schematic view of a solid fuel burner according to a seventh embodiment of the present invention.
Figure 16:
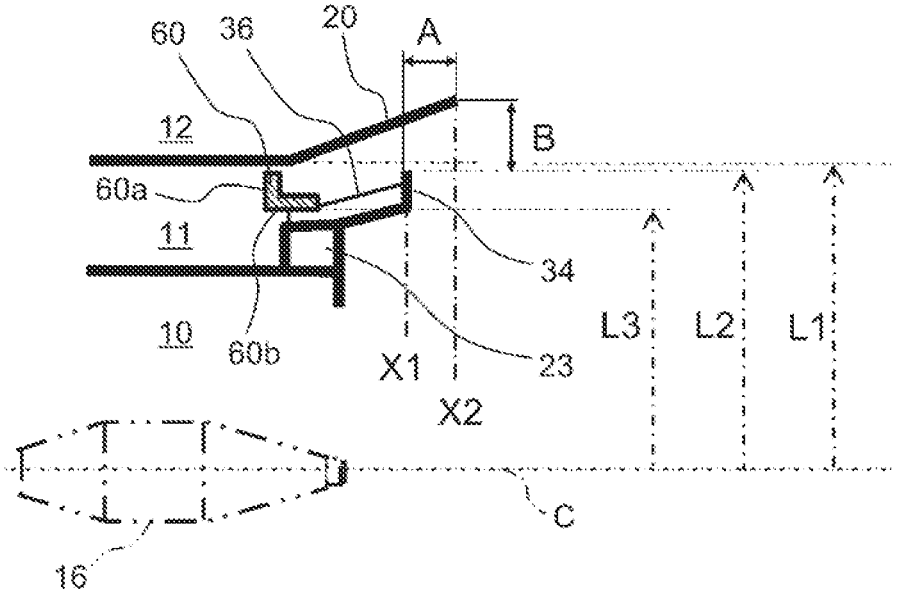
FIG. 16 is an enlarged view of a portion D1 illustrated in FIG. 15.
Figure 17:
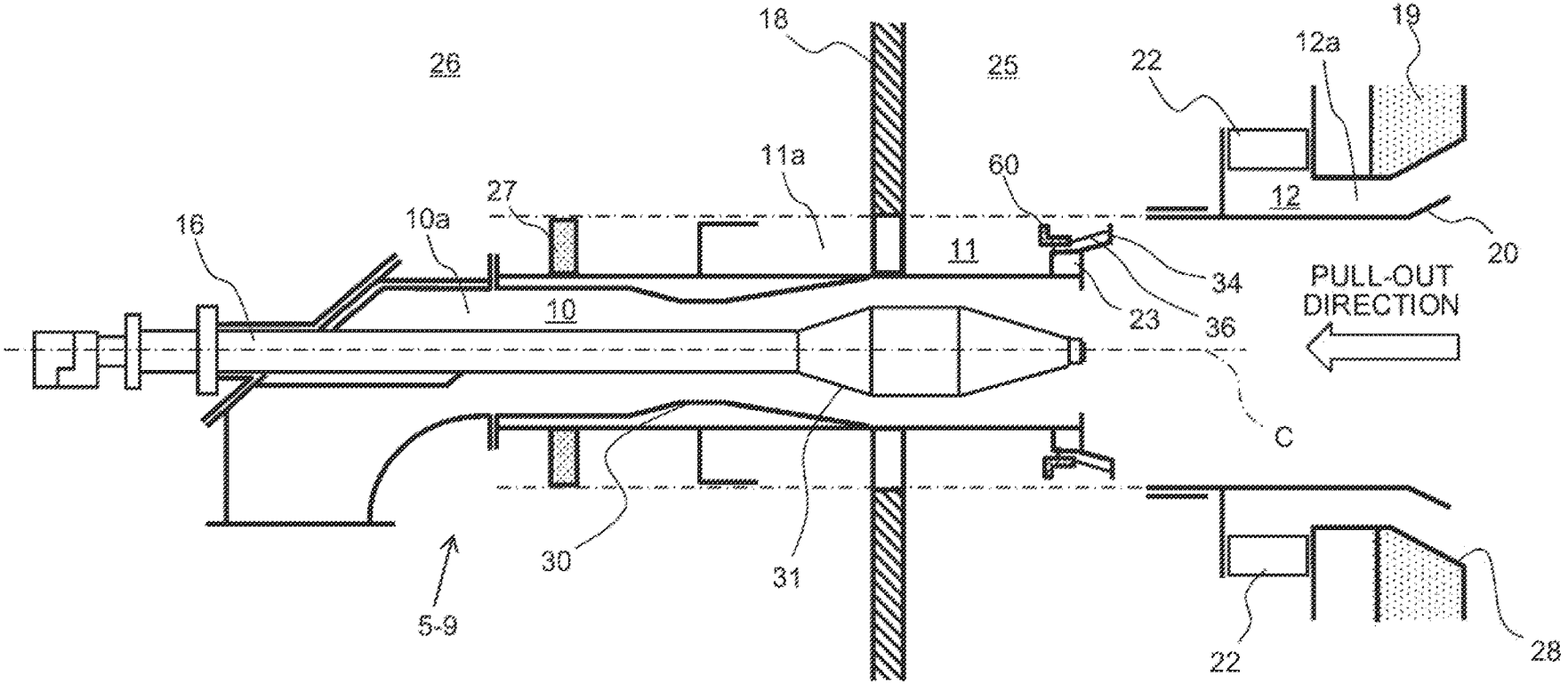
FIG. 17 illustrates a state in which a nozzle tip portion of the solid fuel burner according to the seventh embodiment of the present invention is pulled out.

Next, a solid fuel burner 5-9 according to a seventh embodiment of the present invention will be described. FIG. 15 is a schematic view of the solid fuel burner 5-5 according to the seventh embodiment. FIG. 16 is an enlarged view of a portion D1 illustrated in FIG. 15. FIG. 17 illustrates a state in which the nozzle tip portion of the solid fuel burner according to the seventh embodiment is pulled out. The same components as those of the first to sixth embodiments are provided with the same reference signs, and explanation thereof will be omitted.

As illustrated in FIG. 15 to FIG. 17, the technical feature of the solid fuel burner 5-9 according to the seventh embodiment can be found in a contraction flow formation member 60. In the following, this feature will be mainly explained. As illustrated in FIG. 15 and FIG. 17, in the seventh embodiment, a front plate 27 on which the fuel nozzle 10 is disposed is detachably supported by such as bolts, screws, and hooks with respect to the partition wall 18 so as to be withdrawn integrally with the fuel nozzle 10 during maintenance.

The solid fuel burner 5-3 according to the seventh embodiment includes the flame stabilizer 23. The flame stabilizer 23 includes a plate-shaped fin member 36 which extends along the flow direction of the secondary air 14 and provided in the secondary air flow path 11*a*. The fin member 36 includes a plurality of fins which is disposed at intervals along the circumferential direction of the flame stabilizer 23, and each of them is formed by a radial plate material.

The contraction flow formation member 60 is disposed on the upstream side of the fin member 36. As illustrated in FIG. 16, the contraction flow formation member 60 includes an upstream wall portion 60*a* extending in the radial direction with respect to the burner central axis C, and a cylindrical wall portion 60*b* extending from an inner end of the upstream wall portion 60*a* in the radial direction toward the downstream side of the flow direction of the secondary air 14. Accordingly, in the seventh embodiment, the contraction flow formation member 60 forms an annular gas flow path of which the cross-sectional shape along the axial direction is shaped into L.

The cylindrical wall portion 60*b* of the contraction flow formation member 60 is fixed and supported by the fin member 36, and the contraction flow formation member 60 is movable integrally with the fin member 36. Between the contraction flow formation member 60 and the secondary air nozzle 11, minute clearance which allows movement, in other words, play is formed.

The contraction flow formation member 60 is disposed on the outer peripheral side of the secondary air flow path 11*a* of the secondary air nozzle 11, and accordingly, the cross-section of the flow path is once contracted in the radial direction toward the central axis. That is, the contraction flow formation member 60 narrows the cross-sectional area of the secondary air flow path 11*a*. After passing through the contraction formation member 60, the secondary air reaches the guide ring 34 in a contracted state, and the contraction flow formation member 60 makes the flow of the secondary air spread outwardly from the burner central axis C. The contraction flow formation member 60 is supported from the flame stabilizer 23 side by a member separated from the secondary air nozzle 11. In this connection, the contraction formation member 60 is preferably formed by a ring-shaped member which is uniform over the entire circumferential direction, meanwhile, it may be divided into a plurality pieces in the circumferential direction. Furthermore, the contraction flow formation member 60 is preferably formed integrally with the flame stabilizer 23, meanwhile, it may be formed separately.

Figure 19:
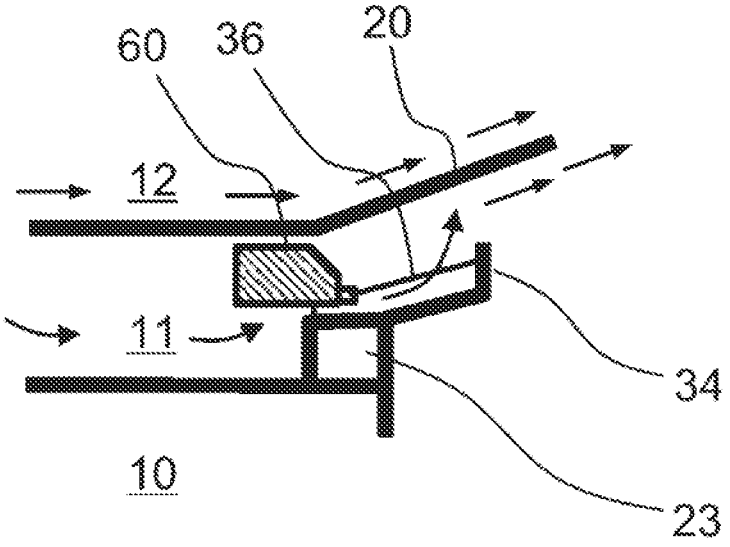
FIG. 19 illustrates a modification of a contraction flow formation member.

In the drawings, the above-described minute clearance, in other words, play formed between the outer peripheral portion of the contraction flow formation member 60 and the inner wall surface of the secondary air nozzle 11 appears large, however, it is extremely minute in practice. Accordingly, a flow rate of the secondary air 14 short-passing through the clearance can be ignored. In order to enhance pressure loss in the clearance, it is desirable to sufficiently secure the length of the outer peripheral surface (surface facing the inner wall surface of the secondary air nozzle 11) of the contraction formation member 60 in the axial direction. The cross-sectional shape of the contraction flow formation member 60 is not limited to the L-shape as illustrated, and for example, as the contraction flow formation member 60 illustrated in FIG. 19, various shapes such as a rectangular shape in which the outer peripheral surface (surface facing the inner wall surface of the secondary air nozzle 11) is extended, or a pentagonal shape can be applied.

Here, the positional relationship between the guide sleeve 20 and the guide ring 34 will be described in detail. As illustrated in FIG. 16, the guide sleeve 20 overlaps with the guide ring 34 in the direction along the burner central axis C (axial direction), and the distal end position X2 of the guide sleeve 20 is at a closer side of the furnace 2 (right side of FIG. 16) than the distal end position X1 of the guide ring 34. In other words, the distal end position X2 is on the downstream side of the air flow further from the distal end position X1. Furthermore, when a distance between the front side surface of the guide ring 34 (side surface opposite to the side surface of the guide ring 34 facing the furnace 2) and the distal end of the inner peripheral surface of the guide sleeve 20, that is, the length in which the guide sleeve 20 overlaps with the guide ring 34 is referred to A, and when a distance between the distal end of the inner peripheral surface of the guide sleeve 20 and the outer peripheral end of the guide ring 34, that is, the gap between the guide sleeve 20 and the guide ring 34 in their height direction is referred to B, the relationship between the length A and the gap B is set to satisfy $A>0.5\times B$. The distal end position X2 of the guide sleeve 20 and the distal end position X1 of the guide ring 34 are accommodated in the burner throat 28, and thus do not project from the inner peripheral surface of the water wall 19 toward the inner side of the furnace 2.

Next, relationship of the size between an inner diameter L1 of the secondary air nozzle 11, an outer diameter L2 of the guide ring 34, and an inner diameter L3 of the contraction flow formation member 60 will be described. As illustrated in FIG. 16, the outer diameter L2 of the guide ring 34 is set smaller than the inner diameter L1 of the secondary air nozzle 11 (L2<1). In the seventh embodiment, the outer diameter of the contraction flow formation member 60 is set to L2 which is the same as the outer diameter of the guide ring 34, meanwhile, the relationship of the size between the outer diameter of the contraction flow formation member 60 and the outer diameter L2 of the guide ring 34 does not matter as long as the outer diameter of the contraction flow formation member 60 is smaller than the inner diameter of the secondary air nozzle 11.

In the seventh embodiment, the outer diameter L2 is set smaller than an outer diameter (inner diameter of the partition wall 18) L4 of the front plate 27 (see FIG. 15) (L2<4). In the seventh embodiment, an inner diameter (distance from the burner central axis C to the cylindrical wall portion 60*b*) L3 of the contraction flow formation member 60 is set smaller than the outer diameter L2 of the guide ring 34 (L2>L3). That is, in the seventh embodiment, it is set that L1>L2>L3.

FIG. 17 illustrates a state in which a nozzle tip portion of the solid fuel burner 5-9 according to the seventh embodiment of the present invention is pulled out. As described above, the solid fuel burner 5-9 according to the seventh embodiment is formed to satisfy the relationship of size of L1>L2>L3. Accordingly, when the front plate 27 is removed from the partition wall 18 to pull out the fuel nozzle 10, the fuel nozzle 10, the flame stabilizer 23, the guide ring 34, the fin member 36, and the contraction flow formation member 60 can be pulled out integrally toward the outside 26 of the furnace 2.

When pulling out the fuel nozzle 10, etc. to the extent in which the contraction flow formation member 60 is positioned at a closer side of the furnace than the partition wall 18 (within the window box 25) without pulling it out completely, the outer diameter L4 of the front plate 27 can be set smaller than the outer diameter L2, or the fuel nozzle 10 may formed to be movable with respect to the partition wall 18 without providing the front plate 27.

Figure 18:
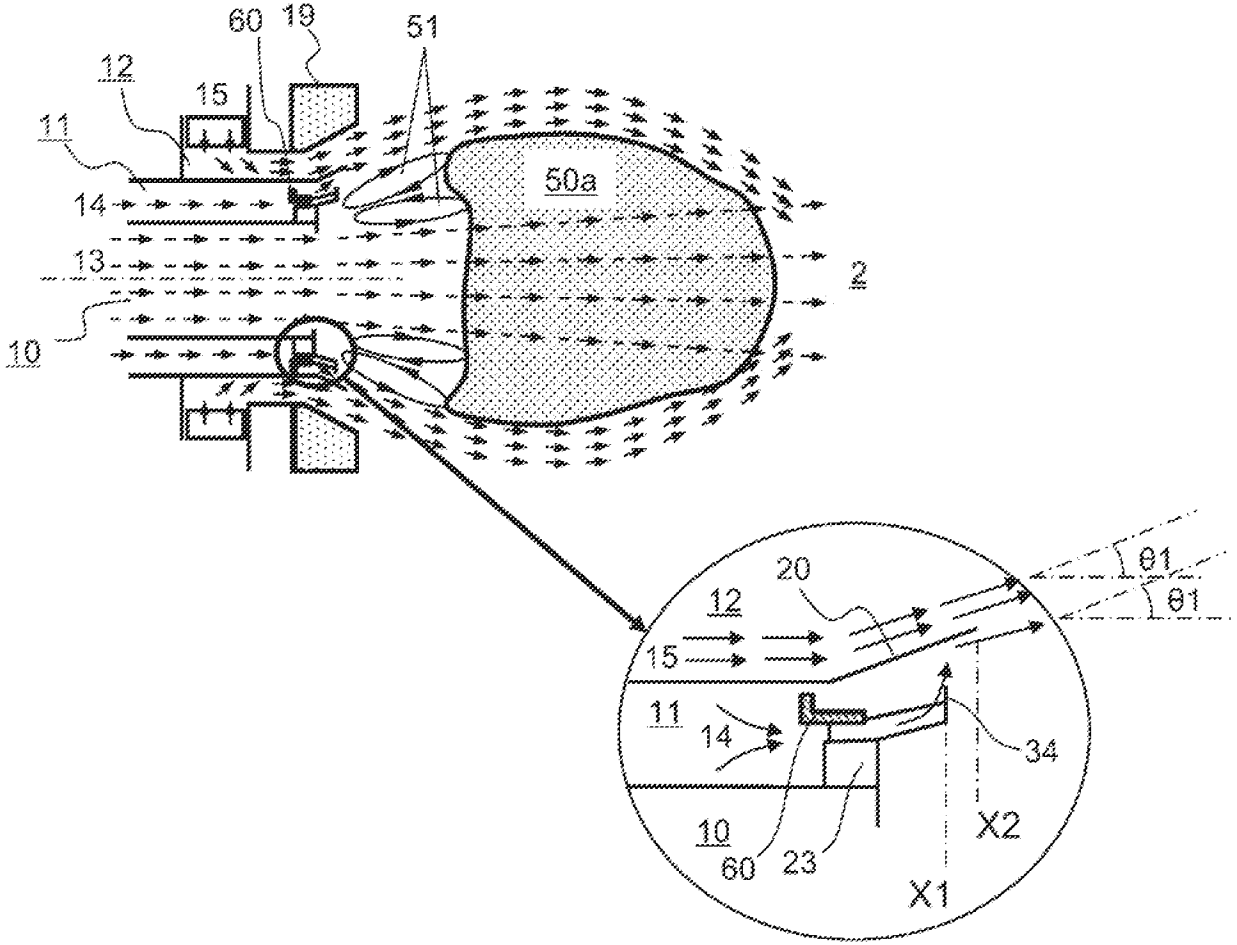
FIG. 18 illustrates a flow of air in a nozzle tip region of the solid fuel burner according to the seventh embodiment of the present invention.

Next, with reference to FIG. 18, a flow of air in the nozzle tip region of the solid fuel burner 5-9 according to the seventh embodiment will be described. FIG. 18 illustrates the flow of air in the nozzle tip region of the solid fuel burner 5-9. As illustrated in FIG. 18, the primary air 13 is ejected from the fuel nozzle 10 into the furnace 2. The secondary air 14 flows in the secondary air nozzle 11, collides with the guide ring 34 of the flame stabilizer 23, and changes its direction outwardly in the radial direction. Since the distal end position X2 of the guide sleeve 20 is at a closer side of the furnace 2 than the distal end position X1 of the guide ring 34, the secondary air 14 which has collided with the guide ring 34 flows along the inner peripheral surface of the portion of the guide sleeve 20, in which the guide ring 34 overlaps with the guide sleeve 20 (portion indicated by A in FIG. 16), and then is ejected at the first angle θ1 with respect to the burner central axis C outwardly in the radial direction into the furnace 2. The tertiary air 15 flows in the tertiary air nozzle 12 and is ejected at the first angle θ1 with respect to the burner central axis C outwardly in the radial direction into the furnace 2 while changing its direction along the guide sleeve 20 toward the outer peripheral side thereof.

As described above, since the distal end position X2 of the guide sleeve 20 is at a closer side of the furnace 2 than the distal end position X1 of the guide ring 34, the guide sleeve 20 can suppress the secondary air 14 from being deflected outwardly in the radial direction. Furthermore, since the first angle θ1 of the guide sleeve 20 is set in the range of 10 degrees to 40 degrees, the secondary air 14 and the tertiary air 15 are deflected outwardly in the radial direction by the first angle θ1 of the guide sleeve 20, and then ejected into the furnace 2. As a result, the reducing flame region 50*a* can be made narrower than that of the above-mentioned prior art, thereby decreasing unburned combustibles of the solid fuel and reducing generation of CO.

Furthermore, since the outer diameter L2 of the guide ring 34 and the outer diameter of the contraction flow formation member 60 are set smaller than the inner diameter L1 of the secondary air nozzle 11, in a step of disassembling the solid fuel burner 5-9 at the time of a periodic inspection of the boiler, the guide ring 34 can be pulled out together with the fuel nozzle 10, etc. (see FIG. 17) without being caught in the secondary air nozzle 11, thereby improving maintainability.

Still further, since the contraction formation member 60 is disposed on the upstream side of the guide ring 34, when the secondary air 14 passes through the contraction flow formation member 60, the flow velocity thereof becomes high. Then, the secondary air 14 collides with the guide ring 34 at a high speed, and is deflected outwardly in the radial direction. Accordingly, in the seventh embodiment, even if the outer diameter L2 of the guide ring 34 is small, deflection of the secondary air 14 to be ejected in the radial direction is increased, and a circulating flow formed on the downstream side of guide ring 34 can be secured. As a result, the flame is stabilized and low NOx performance can be maintained.

Needless to mention, the contraction flow formation member 60 described in the seventh embodiment is applicable to the solid fuel burners according to the first to sixth embodiments described above.

It should be noted that the present invention is not limited to the embodiments described above, and various modifications can be made without departing from the concept of the present invention. All technical matters included in the technical idea described in the claims are the subject matter of the present invention. The embodiments described above show preferred examples, on the other hand, those skilled in the art may realize various alternatives, modifications, variations, or improvements in light of the teachings disclosed herein, and they are within the scope of the appended claims.

For example, the solid fuel burner according to the present invention may include the seal air introduction plate 40 and the seal air deflection plate 42 while not including the seal air leading cylindrical portion 44. Furthermore, the case where the first angle θ1 and the third angle θ3 are substantially the same has been described above, meanwhile, they may not necessarily be the same angle as long as within the range of 10 degrees to 40 degrees.

REFERENCE SIGNS LIST

1 boiler equipment
2 furnace
5-1 to 5-10 solid fuel burner
6 spacer
7 support
10 fuel nozzle (solid fuel nozzle)
11 secondary air nozzle
12 tertiary air nozzle
13 primary air (mixed fluid)
14 secondary air
15 tertiary air
19 water wall (wall portion)
20, 20*a*, 20*b* guide sleeve (tertiary air guide member, combustion gas guide member)
23 flame stabilizer
23 burner throat
34 guide ring (secondary air guide member)
40 seal air introduction plate (seal air introduction member, seal gas introduction member)
42 seal air deflection plate (seal air deflection member, seal gas deflection member)
44 seal air leading cylindrical portion (seal air leading member, seal gas leading member)
48 seal air deflection suppressing plate (seal air deflection suppressing member)
50*a*, 50*b* reducing flame region
60 contraction flow formation member
C burner central axis
NU nozzle tip unit (guide vane unit)

The invention claimed is:

1. A solid fuel burner to be inserted into a burner throat bored in a wall portion of a furnace, the solid fuel burner comprising:

a solid fuel nozzle for ejecting mixed fluid of solid fuel and primary air;

a secondary air nozzle for ejecting secondary air, which is provided concentrically with the solid fuel nozzle on an outside of the solid fuel nozzle;

a tertiary air nozzle for ejecting tertiary air, which is provided concentrically with the secondary air nozzle on an outside of the secondary air nozzle;

a secondary air guide member for guiding a flow of the secondary air outwardly in a radial direction, which is positioned on an outer peripheral portion at a distal end of the solid fuel nozzle; and one or more tertiary air guide members for guiding a flow of the tertiary air outwardly in the radial direction at a first angle with respect to a central axis of the solid fuel burner, which are provided on a distal end of the tertiary air nozzle, wherein a distal end position of each of the tertiary air guide members in an axial direction of the solid fuel burner is at a closer side of the furnace than a distal end position of the secondary air guide member, the burner throat is formed such that an inner peripheral surface thereof inclines at a second angle with respect to the central axis to expand a diameter from a burner side of the wall portion of the furnace toward a furnace side, the first angle is set in a range of 10 degrees to 40 degrees with respect to the central axis, the second angle is greater than the first angle, a seal air introduction member for introducing a part of the tertiary air as seal air is provided between the tertiary air guide member and the burner throat, the seal air introduction member is inclined outwardly in the radial direction at a third angle with respect to the central axis, a seal air deflection member for deflecting the seal air outwardly in the radial direction is provided on a distal end portion of the seal air introduction member, and the seal air deflection member and a distal end position of the seal air introduction member are housed within the burner throat so as to be closer to the burner than an open surface in the axial direction, the open surface being defined by a furnace-side axial edge of the inner peripheral surface of the burner throat.

2. The solid fuel burner according to claim 1, wherein a seal air leading member for leading the seal air to the seal air introduction member is further provided on an end portion of the seal air introduction member at an upstream side of the flow of the tertiary air.

3. The solid fuel burner according to claim 1, wherein the distal end position of the seal air introduction member in the axial direction of the solid fuel burner is on a substantially same position of the distal end position of each of the tertiary air guide members or at a closer side of the furnace than the distal end position of each of the tertiary air guide members.

4. The solid fuel burner according to claim 1, wherein the third angle is set to be substantially same as the first angle.

5. The solid fuel burner according to claim 1, wherein a seal air deflection suppressing member for suppressing deflection of the seal air is provided between the seal air introduction member and the burner throat.

6. The solid fuel burner according to claim 5, wherein the seal air deflection suppressing member is a plate on which a large number of holes or slits are formed.

7. Boiler equipment comprising the solid fuel burner according to claim 1.

8. A nozzle unit inserted into a burner throat bored in a wall portion of a furnace and being applied to a solid fuel burner, the solid fuel burner including:

a solid fuel nozzle for ejecting mixed fluid of solid fuel and primary air, a secondary air nozzle for ejecting secondary air, which is provided concentrically with the solid fuel nozzle on an outer periphery side of the solid fuel nozzle;

a tertiary air nozzle for ejecting tertiary air, which is provided concentrically with the secondary air nozzle on an outer periphery side of the secondary air nozzle; and a secondary air guide member for guiding a flow of the secondary air outwardly in a radial direction, which is positioned on an outer peripheral portion at a distal end of the solid fuel nozzle, the nozzle unit being disposed on an outer peripheral portion at a distal end of the secondary air nozzle, and the nozzle unit comprising:

a plurality of tertiary air guide members for guiding a flow of the tertiary air outwardly in the radial direction at a first angle with respect to a central axis of the solid fuel burner;

a seal air introduction member for introducing a part of the tertiary air as seal air to guide the seal air outwardly in the radial direction at the first angle, which is provided on an outside of the plurality of tertiary air guide members in the radial direction;

a seal air leading member for leading the seal air to the seal air introduction member, which is provided on an end portion of the seal air introduction member at an upstream side of the flow of the tertiary air;

a seal air deflection member for deflecting the seal air outwardly in the radial direction, which is provided on a distal end portion of the seal air introduction member, and the seal air deflection member and a distal end position of the seal air introduction member are housed within the burner throat so as to be closer to the burner than an open surface in the axial direction, the open surface being defined by a furnace-side axial edge of the inner peripheral surface of the burner throat.

9. A guide vane unit detachably disposed on an outer peripheral portion at a distal end of a solid fuel nozzle provided in a solid fuel burner to be inserted into a burner throat bored in a wall portion of a furnace ejecting mixed fluid of solid fuel and carrier gas so as to guide combustion gas flowing on an outer peripheral side of the solid fuel nozzle, the guide vane unit comprising:

a plurality of combustion gas guide members for guiding a flow of the combustion gas outwardly in a radial direction at a first angle with respect to a central axis of the solid fuel burner, which is disposed having intervals therebetween in the radial direction;

a seal gas introduction member for introducing a part of the combustion gas as seal gas to guide the seal gas outwardly in the radial direction at the first angle, which is provided on an outside of the plurality of combustion gas guide members in the radial direction;

a seal gas leading member for leading the seal gas to the seal gas introduction member, which is provided on an end portion of the seal gas introduction member at an upstream side of the flow of the combustion gas;

a seal gas deflection member for deflecting the seal gas outwardly in the radial direction, which is provided on a distal end portion of the seal gas introduction member, and the seal air deflection member and a distal end position of the seal air introduction member are housed within the burner throat so as to be closer to the burner than an open surface in the axial direction, the open surface being defined by a furnace-side axial edge of the inner peripheral surface of the burner throat.

10. The solid fuel burner according to claim 1, wherein a contraction flow formation member for narrowing a cross-sectional area of a flow path through which the secondary air flows, which is disposed on an upstream side of the secondary air guide member with respect to a flow direction of the secondary air is provided, an outer diameter of the secondary air guide member is formed smaller than an inner diameter of an outer peripheral wall of the secondary air nozzle, the distal end position of each of the tertiary air guide members in the axial direction of the solid fuel burner is at a closer side of the furnace than the distal end position of the secondary air guide member, and the solid fuel nozzle, the secondary air guide member, and the contraction flow formation member can be integrally pulled out from the burner throat.

11. The solid fuel burner according to claim 10, wherein when the inner diameter of the outer peripheral wall of the secondary air nozzle is referred to L1, the outer diameter of the secondary air guide member is referred to L2, and an inner diameter of the contraction flow formation member is referred to L3, relationship L1>L2>L3 is satisfied.

12. The solid fuel burner according to claim 10, wherein a seal air leading member for leading the seal air to the seal air introduction member is further provided on an end portion of the seal air introduction member at an upstream side of the flow of the tertiary air.

13. The solid fuel burner according to claim 10, wherein a distal end position of the seal air introduction member in the axial direction of the solid fuel burner is on a substantially same position of the distal end position of each of the tertiary air guide members or at a closer side of the furnace than the distal end position of each of the tertiary air guide members.

14. The solid fuel burner according to claim 10, wherein the third angle is set to be substantially same as the first angle.

15. The solid fuel burner according to claim 10, wherein a seal air deflection suppressing member for suppressing deflection of the seal air is provided between the seal air introduction member and the burner throat.

16. The solid fuel burner according to claim 15, wherein the seal air deflection suppressing member is a plate on which a large number of holes or slits are formed.

* * * * *